US011844977B2

(12) United States Patent
Higginson

(10) Patent No.: US 11,844,977 B2
(45) Date of Patent: Dec. 19, 2023

(54) DOUBLE RETRACTABLE ROWING RESISTANCE SYSTEM WITH CONFIGURABLE AND CONVERTIBLE SWINGING SEAT-BASED EXERCISE MACHINE

(71) Applicant: Timothy B. Higginson, Cohasset, MA (US)

(72) Inventor: Timothy B. Higginson, Cohasset, MA (US)

(73) Assignee: Timothy B. Higginson, Cohasset, MA (US)

( * ) Notice: Subject to any disclaimer, the term of this patent is extended or adjusted under 35 U.S.C. 154(b) by 110 days.

(21) Appl. No.: 17/532,481

(22) Filed: Nov. 22, 2021

(65) Prior Publication Data

US 2022/0161094 A1 May 26, 2022

Related U.S. Application Data

(60) Provisional application No. 63/117,015, filed on Nov. 23, 2020.

(51) Int. Cl.
*A63B 22/00* (2006.01)
*A63B 69/06* (2006.01)
(Continued)

(52) U.S. Cl.
CPC .... *A63B 22/0076* (2013.01); *A63B 21/00069* (2013.01); *A63B 21/0414* (2013.01);
(Continued)

(58) Field of Classification Search
CPC ..... A63B 22/0076; A63B 21/00069; A63B 21/0414; A63B 21/0552; A63B 21/4034; A63B 69/06; A63B 2022/0094; A63B 2071/0072; A63B 2071/0652; A63B 21/4033; A63B 7/00; A63B 22/0605;
(Continued)

(56) References Cited

U.S. PATENT DOCUMENTS 3,204,261 A * 9/1965 Garehime, Jr. ..... A63B 35/00 114/354
3,898,950 A * 8/1975 Martin ..... B63H 16/06 440/105

(Continued)

*Primary Examiner* — Andrew S Lo
(74) *Attorney, Agent, or Firm* — Leydig, Voit & Mayer, Ltd.

(57) ABSTRACT

An exercise machine is described that incorporates a double retractable resistance band system for rowing exercises and that includes a multi-purpose, morphable swinging seat assembly that applies to convertible exercise machines and rowing boats. The double retractable rowing system is detachably integrated into a base plate (inclined planar board) of the exercise machine. The base plate consists of a platform set at an angle consistent with the foot-placements of sit-down rowing machines and rowing shells together with an integral set of quick-release slots located above and to the outside of the toes of the foot placement positions. The multi-purpose, morphable swinging seat assembly provides an improved method/structural assembly for seat-based rowing machines, convertible/multi-purpose exercise machines and an improved architecture for boat-based rowing systems.

10 Claims, 32 Drawing Sheets

(51) Int. Cl.
*A63B 21/00* (2006.01)
*B63H 16/067* (2006.01)
*A63B 21/055* (2006.01)
*A63B 21/04* (2006.01)

(52) U.S. Cl.
CPC ..... *A63B 21/0552* (2013.01); *A63B 21/4034* (2015.10); *A63B 69/06* (2013.01); *B63H 16/067* (2013.01)

(58) Field of Classification Search
CPC .... A63B 2022/0041; A63B 2022/0079; A63B 2069/062; A63B 2210/50; A63B 2225/107; A63B 21/28; A63B 22/0087; A63B 22/0694; A63B 2220/17; A63B 2220/40; A63B 2225/20; A63B 2230/06; A63B 2230/62
See application file for complete search history.

(56) References Cited

U.S. PATENT DOCUMENTS 4,516,941 A * 5/1985 Reid ..... B63H 16/06 440/105
4,649,852 A * 3/1987 Piantedosi ..... B63H 16/02 440/105
5,470,295 A * 11/1995 Wang ..... A63B 21/068 482/96
5,899,780 A * 5/1999 Robbins ..... B63H 16/02 440/105
5,975,004 A * 11/1999 Nesseth ..... B63H 16/105 440/102
6,109,988 A * 8/2000 Dunn, Jr. ..... B63H 16/06 440/106
6,939,186 B1 * 9/2005 Kuckes ..... B63H 16/107 440/102
7,517,267 B2 * 4/2009 Nesseth ..... B63H 16/105 440/105
7,862,484 B1 * 1/2011 Coffey ..... A63B 21/157 482/72
8,540,537 B1 * 9/2013 Wong ..... B63H 16/00 440/104
11,311,768 B2 * 4/2022 Mora ..... A63B 21/0442
2003/0166438 A1 * 9/2003 Gramaccioni ..... A63B 26/003 482/72
2008/0039290 A1 * 2/2008 Manguso ..... A63B 21/4034 482/96
2009/0017994 A1 * 1/2009 Ellis ..... A63B 21/153 482/72
2012/0100965 A1 * 4/2012 Dreissigacker .... A63B 22/0005 482/72
2016/0068230 A1 * 3/2016 Clinton ..... B63B 1/121 440/101
2016/0375297 A1 * 12/2016 Kiser ..... A63B 69/06 482/73
2019/0299052 A1 * 10/2019 St.Cyr ..... A63B 21/22
2022/0408927 A1 * 12/2022 Aoki ..... A63B 21/4031

* cited by examiner

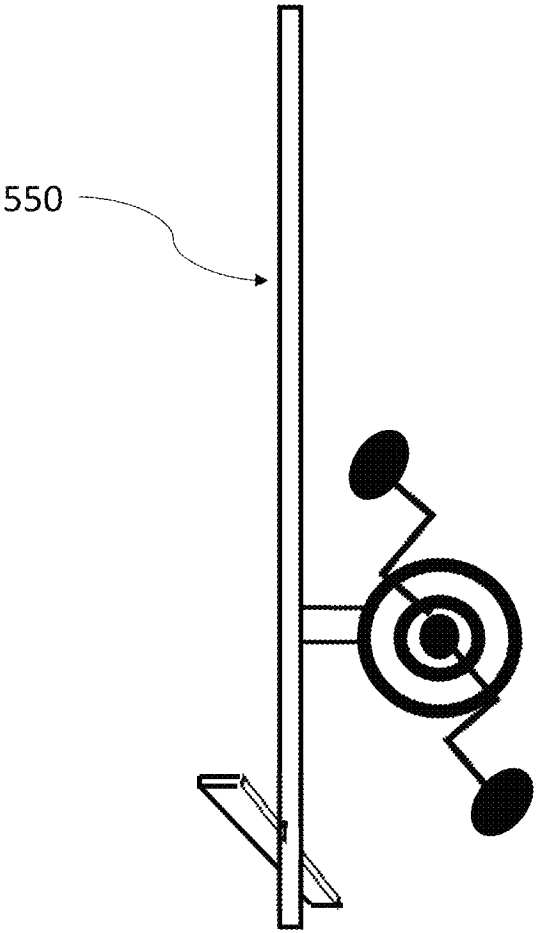
Fig. 18B
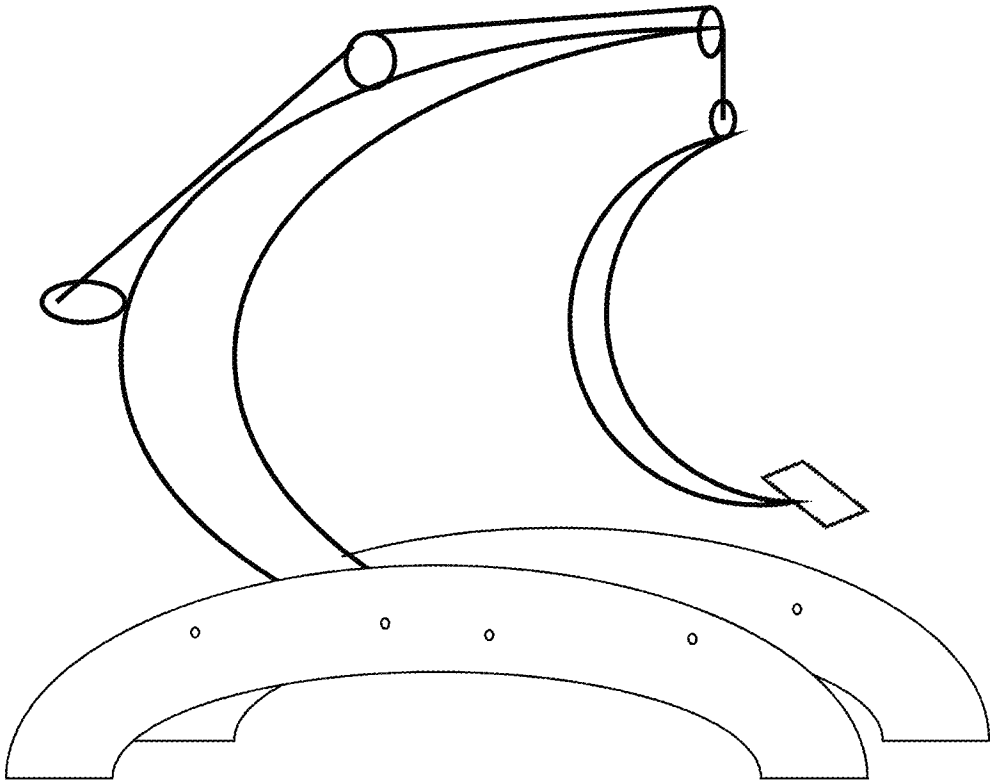

DOUBLE RETRACTABLE ROWING RESISTANCE SYSTEM WITH CONFIGURABLE AND CONVERTIBLE SWINGING SEAT-BASED EXERCISE MACHINE

CROSS-REFERENCE TO RELATED APPLICATIONS

This application claims the benefit of U.S. Provisional Application No. 63/117,015, filed Nov. 23, 2020, which is expressly incorporated by reference in its entirety, including any references contained therein.

FIELD OF THE INVENTION

The present invention generally relates to exercise machines, and more particularly, the invention relates to a portable rowing stroke exercise machine that is further installable as an improved rowing system for rowing boats, and that is re-configurable and convertible.

BACKGROUND OF THE INVENTION

Known rowing exercise machines, while offering an excellent workout, are far more complex and costly than necessary for providing a workout that approximates rowing in a boat on water. Such machines typically are: 6 feet or more in length, difficult to lift and move due to their size and weight, take up substantial space when stored, and frequently cost well over a thousand dollars (often substantially more). They include sliding seats, a fly-wheel, electromagnetic draft or water-wheel-based resistance system to simulate the motion and resistance through the water of an oar. They have many complex moving parts. They require a lot of floor and storage space. These characteristics present problems in homes, apartments, offices, cubicles and even gyms, where open floor and storage space is at a premium.

Further, known rowing exercise machines are designed for use while sitting down. However, sitting is a major health issue as people sit more and more of their day at desks, in cars and other transit systems, in coffee shops, on couches, in waiting areas and other places.

A major determinant of size, complexity and cost are the components and system that simulates the repetitive rowing stroke cycle consisting of two parts: (1) the oar blade moving through the water during the rowing stroke (the "in-water phase"), and (2) the oar blade moving through the air to return it to the position whereby the oar blade can be placed in the water anew (the "in-air phase"). For rowing machines, this requires a system whereby the rower holds a simulated oar handle, and (1) during the in-water phase, the rower exerts force by motion from rower's legs, arms, core and back muscles to move a virtual oar blade through virtual water, and (2) during the in-air phase, the simulated oar handle remains attached to the virtual oar blade throughout the body motion that returns the oar handle to the beginning of the "in-water" position of the rowing stroke cycle.

Some rowing machines, such as the Concept 2, use an oar handle attached via a chain to a spinning disk that uses fan blades to simulate water resistance. Other rowing machines, use spinning blades in a water-filled container. Yet other rowing machines, such as the Hydrow, use an oar handle attached via a cable to an electro-magnetic, software-driven resistance system.

Additional drawbacks of many rowing machines include, for instance, a rowing stroke that does not accurately simulate the hand positioning/movement of actual rowing on water. Many rowing machines (including the Concept 2 and the Hydrow) have a single handle that moves and has resistance directly along the center of the long axis of the rowing machine and the rower's body. This does not accurately reflect the motion of either a sculler (two oars, each held independently by a hand, where the hands are wide apart at the start of the stroke, cross over each other—one above and one below—during the stroke and finish with the hands spread wide apart. The typical rowing machine stroke also does not accurately reflect the motion of rowers holding a single oar (a "sweep") whereby the hand motion inscribes an arc (not a straight line) that is a mirror image depending on whether the rower is using a starboard side oar or a port oar, and wherein the motion involves both hands on the oar's handle. However, the hand on the non-blade end of the oar reaches across the body of the rower in the direction of the side of the boat where the blade of the oar will enter the water, that hand reaches farther than the other hand, and the pull-through of the stroke moves the hands in an arc to the finish.

Other known rowing machines attempt to provide a motion similar to that of the independent hand motion of a sculling row stroke, but these machines generally do not have the capability of offering the motion of either a single ("sweep") oar rower and a straight forward and back, in-line motion.

Furthermore, availability of the rowing machines for use are a challenge. Studies increasingly establish the importance of short intervals of cardio activity throughout the day to maintain and improve health and offset the sedentary lifestyle common to many people, including at work, at home and in cars, buses, trains and planes. Certain types of exercise equipment providing short interval cardio exercise, such as jump ropes, are small enough in size to be at hand in many of these locations. However, jump rope exercise is impractical at virtually any workplace. For instance, it is virtually impossible (and likely to be extremely annoying) to jump rope in a cubicle, shared office space, or a small apartment.

Additionally, all current rowing machines and rowing components in rowing shell boats are based on some form of seat that slides forward and back. This creates friction throughout the stroke, thereby decreasing the effectiveness of the energy exerted by the rower translated into the water via the oar to move the boat forward. The friction occurs throughout the stroke as the seat moves forward and back. In rowing machines, the seat slides forward and back along a center beam. In rowing shells, the seat moves forward and back generally using a set of wheels that move forward and back on a track assembly that also adds weight to the boat.

A further detriment of the system that slides a seat forward and back on a fixed rail (or beam) used in rowing machines is that the system fails to train a rower to balance their weight carefully as the rower moves forward and back during the rowing stroke. This creates a false measure of success and mis-trains a rower because when a rower is in a boat, it is critical to maintain the boat at all times balanced evenly over the centerline keel and without tipping from side-to-side. If a boat is tipping from side-to-side because a rower's weight is not carefully aligned throughout the forward and back motion of a rowing stroke along the fore-and-aft keel line of the boat, it upsets the ability of the rower to pull their oars cleanly through the water and to pull them out of the water at the end of a stroke, and, in boats with multiple rowers, it throws off all the other rowers, thereby slowing the whole boat down and disrupting its smooth run through the water. Hence, rowing machines that do not train rowers to be aware at all times of their balance throughout their stroke are misleading and mis-training the rower and the rower's coaches in terms of the rower's actually strength and efficiency on the water. Many rowing machines track stroke count and other measures of the rower's use of the rowing machine that ostensibly accurately reflect the user's rowing effectiveness and strength, however those tracking statistics are misleading at least because the machines allow a rower to achieve high scores without measuring their weight distribution and movement laterally during the rower's fore-and-after movement throughout all the strokes in a rower's session. Without calibrating the rower's scores with the rower's weight movement, the rower's effectiveness on the rowing machine does not necessarily correlate highly to the rower's effectiveness when rowing in a boat.

A further disadvantage of rowing machines for home use is that they take up a lot of space and have a single purpose: exercise equipment. Not everyone wants a large piece of exercise equipment in a room in their house or apartment, whether or not it can be shifted vertically or folded when not in use. Further, they weigh a lot, partly in order to be stable when a rower is sitting on them and exercising using them. However, the large size, heavy weight and single purpose mean that they are not suitable to many home environments, and are not easily moved into place for use and then moved to storage when not in use.

An additional disadvantage of traditional rowing machine designs is that their rowing oar and retraction system can get repetitive for many people who would appreciate mixing their workouts. A mixed set of workouts (cross-training) can be advisable for optimal conditioning, as well as for maintaining interest by diversifying the types of workouts available with a single machine.

A further, additional disadvantage of traditional rowing machine designs is a seat that is not designed for changing for rowers with different sizes, weight, flexibility, ages and other characteristics rowers. Further, even if a seat is removable with some effort, the alternative seat designs that can be attached are close to identical to the one removed, thereby not allowing for a full set of customizations based on a complete set of the user's characteristics.

BRIEF SUMMARY OF THE INVENTION

The present invention provides a double-retractable resistance band system for implementing the in-water and in-air rowing stroke cycle in a stand-up rowing machine for exercising. The rowing machine includes a base that is set at an angle consistent with the foot-placements of sit-down rowing machines and rowing shells together with an integrated set of fast-release slots for interchangeable and re-positionable resistance bands. On the under-side of the rowing machine's base, the primary resistance band runs through a centering component and then loops around a re-positionable secondary resistance band. The secondary resistance band serves to maintain the first resistance band in a taught position throughout the rowing stroke, including, in particular, as the rower's hands and body are moving in the "in-air" cycle of the rowing stroke whereby the tension on the primary resistance band is released. Further, the secondary resistance band is re-positionable to accommodate different stroke lengths of a rower (by shortening or lengthening the topside length of the ends of the primary resistance tube), and to provide an optimal maintenance of the positioning and tautness of the primary resistance band for each of the sculling, starboard single oar, port single oar rowing and straight-on rowing strokes.

A stand-up rowing machine implementation provides short interval cardio exercise through a device size that fits in almost any cubicle, under a desk, in a small room filled with other furniture and can be carried outside onto a porch, deck, greenway, office conference room or break room, etc.

The scope of physical (all-body) workout from rowing is well established. By converting it into a vertical motion, additional benefits are achieved, such as described in the foregoing paragraph, and, additionally, such as incorporating body balance (which is also a key factor in the effectiveness of an on-water rowing stroke as unbalancing the boat while rowing causes many detrimental issues) and increased cardio workout intensity arising from additional exertion needed to counter gravity as the body moves upwards and then downwards (also incorporating isometric benefits).

While what is described herein is a stand-up rowing machine, the double-retractable resistance band system may also be implemented/incorporated into a more traditional sit-down and sliding-seat rowing machine configuration.

Further, the foregoing can be implemented as part of a configurable and convertible rowing/exercise system that uses a seat that swings in the air rather than moving on a rail or in a set of tracks, and the swinging chair design allows for a detachable rowing machine section which, when removed from the swing component, leaves a swinging chair piece of furniture with only a much more manageable component to be stored when not in use as a rowing machine. Further, by removing the sliding seat components from the center beam, the center beam can be constructed to be of lighter weight because it does not have to support the weight of the rower throughout each rowing stroke. This creates a re-configurable/convertible rowing machine whereby the main rowing components are lightweight, detachable and easily stored, and the swing chair component allows for non-rowing seat configurations and a wide range of entirely new appearances/designs. It further creates a re-configurable/convertible exercise machine whereby the swing seat component is separate from but allows for the insertion/attachment of multiple alternative excerise components, including a rowing component as well as, for example, a recumbent bike component.

BRIEF DESCRIPTION OF THE DRAWINGS

FIG. 18B depicts a side view similar to FIG. 18A with an alternate detachable, interchangeable exercise component.

DESCRIPTION OF ILLUSTRATIVE EXAMPLES DEPICTED IN THE DRAWINGS

Figure 1:
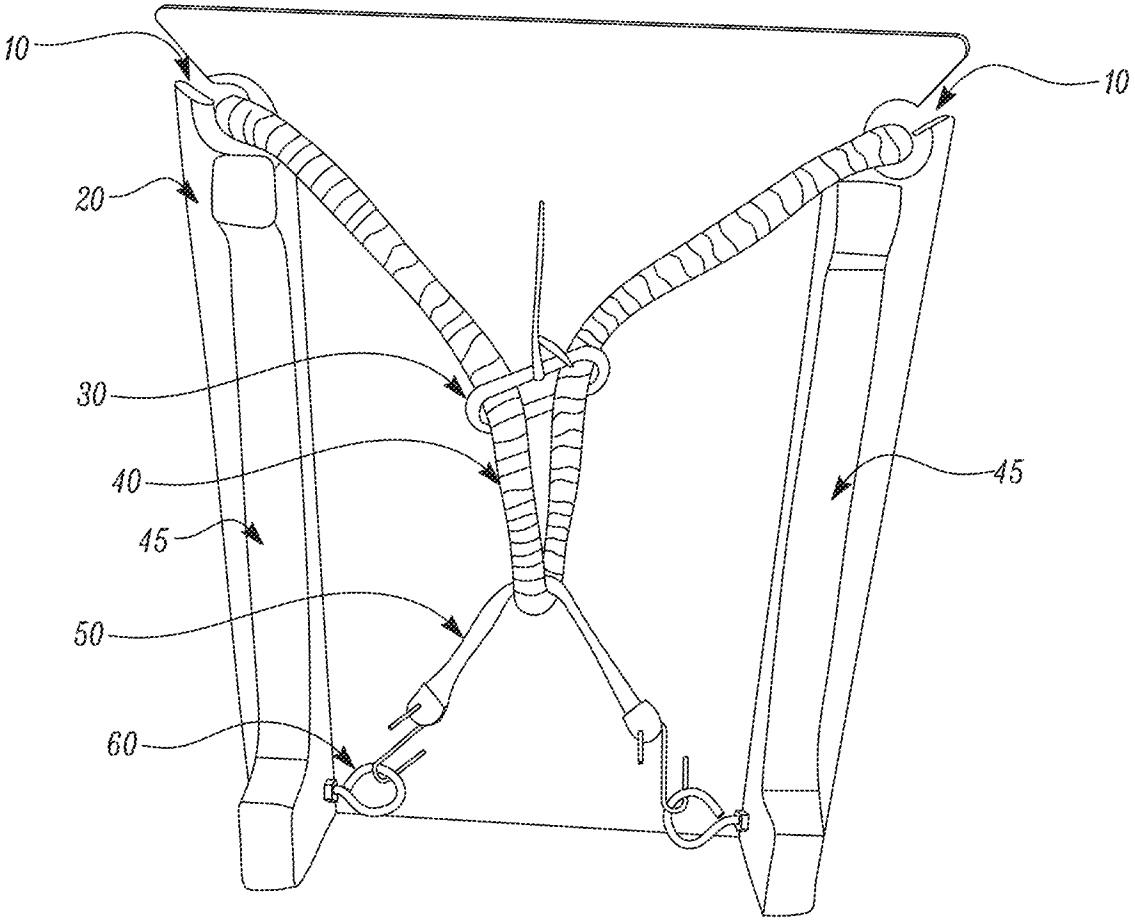
FIG. 1 depicts a back view of a planar, portable exercise apparatus.

FIG. 1 is a bottom view of an apparatus that constitutes an illustrative example of an inventive portable exercise apparatus. The illustrative example includes a foot base/inclined planar surface (base) 20 and a primary resistance tube 40 in place in a set of two front-located quick-release slots 10 in the base 20. Further, a secondary resistance tube 50 is shown where each end is detachably hooked to a set of fixed attachment points 60 located on an inside of a set of legs 45 of the base 20. The primary resistance tube 40 is looped around the center of the secondary resistance tube 50. A centering component 30 is shown with a center loop of the primary resistance tube 40 running through the centering component 30 and from there looping around the center of the secondary resistance tube 50.

It is specifically noted that the illustrative examples utilize hollow rubber tubing for the primary resistance tube 40 and a solid rubber band for the secondary resistance tube 50. However, in alternative embodiments, any type of a vast variety of materials and configurations of elastic band may be utilized. Thus, embodiments of the inventive portable exercise apparatus will include any of a variety of "elastic band", including hollow surgical tubing, solid rubber bands (both flat and round cross-sections) and other resistance materials and components. Further, the area of the looped resistance band 40 that is held in the hands may be exchanged for a resistance band with separate hand-held handles on each end, or may the handheld area of a continguous loop band may have an affixed or detachable grip handle.

Generally, the present disclosure relates to an exercise machine. The exercise machine has an inclined planar base board surface area with two quick release slots for inserting and holding in a multiplicity of positions and quick change-out of a variety of primary fitness resistance tubes (or bands) with the selected primary resistance tube looping around (and maintained in position and tautness) by a secondary resistance tube.

The inclined planar base board surface is higher at the back end (heel end), and closer to the floor at the front end (toe end), and positioned stably in an incline through the positioning and height of a footing system whereby the back of the footing system is higher, the front of the footing system is closer to the ground and also the front of the footing system holds the front of the inclined surface at least at a height sufficient to permit the primary resistance tubing to run unimpeded underneath the front of the inclined surface, and the footing system as a whole provides an area for the position and workings of the assembly and motion of the components forming the double retractable resistance system.

In alternative illustrative examples of the invention, the footing system can be implemented to allow for a variety of inclines to be selected by the user. This can be accomplished, for instance, by utilizing stackable shims for each of the back feet.

A further alternate illustrative example of the invention is one in which the structure has extended height front and back feet, such that the front feet extend below and outwards from the front edge of the inclined surface such that the quick release slots are located NOT on the inclined surface, but, instead on the footing extensions such that the resistance tube is located below and in front of the front (toe) edge of the inclined surface. This permits the rowing motion of the hands at the "catch" of the rowing stroke to extend over and in front of the toes of the feet of the user, thereby enabling a longer rowing stroke by extending available area for the hand-reach at the catch.

The easy, small footprint storage mode of this illustrative example is achieved using a design of the back feet that permits a stable, upright positioning of the machine. This is a major advantage over large, cumbersome rowing machines that require large amounts of storage space and awkward and difficult movements (and even partial dismantling and/or folding of such a device) in order to store it when not in use.

Figure 2:
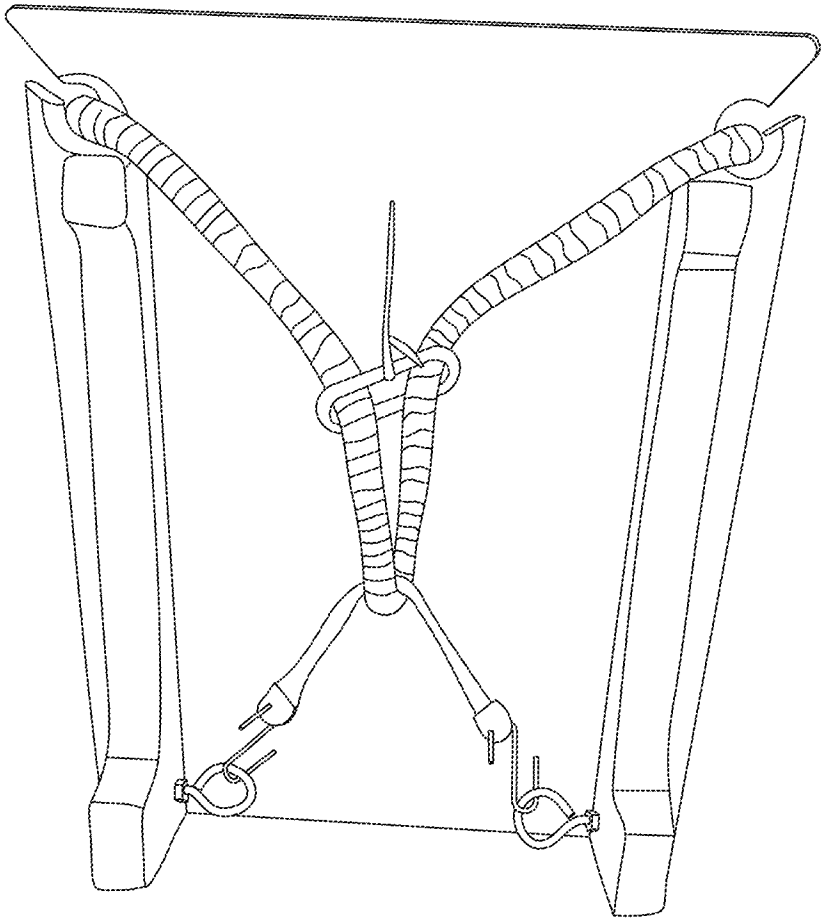
FIG. 2 depicts a back view of a planar, portable exercise apparatus with a focus on dual retraction cords.

FIG. 2 is a similar view to FIG. 1 except omitting the arrows and numbering in order to have a clearer view. In the illustrative example, a primary purpose of the centering component 30 is to gather the lower loop of the primary resistance tube 40 at a central point where the run of the ends to the quick release slot(s) 10 does not run against the footing system and also where the lower end of the primary resistance tube 40 loops through the secondary resistance tube 50 along a central axis of the base 20 board and at a central point of the secondary resistance tube 50.

Figure 3:
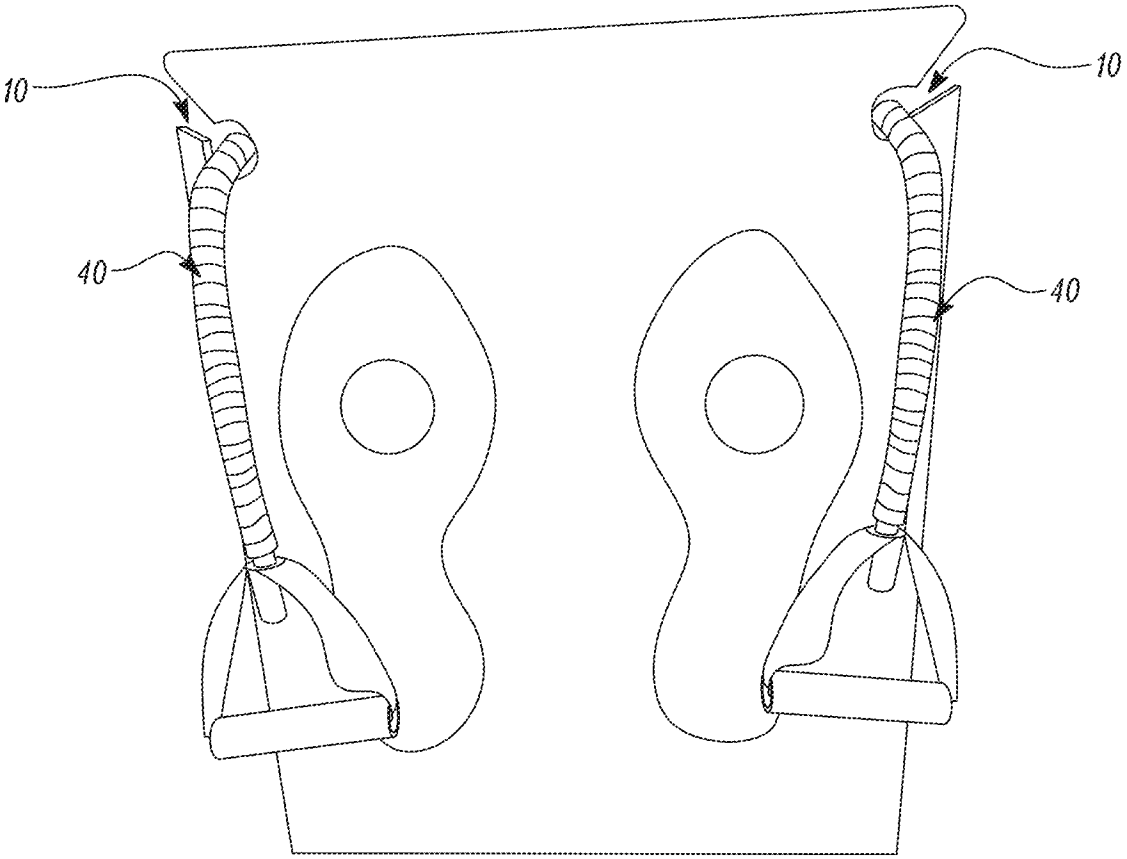
FIG. 3 depicts a front view of a planar, portable exercise apparatus.

FIG. 3 is a top view of the illustrative example of the invention with the primary resistance tube 50 in place illustrating it positioned with one end in each of the two quick release slots 10—a configuration for sculling (cross-over hand movement) and straight-on rowing strokes—as well as depicting foot placement on the top surface of the planar base board. In the sculling stroke, the user holds the left handle of the primary resistance tube in the user's right hand, and the right handle of the primary resistance tube in the user's left hand, thereby providing for an accurate full range of movement and motion of a sculling stroke. In the straight-on stroke, which is similar to most rowing machines (but not reflective of the actual motion used in on-water rowing), the right handle is held in the right hand, and the left handle in the left hand.

Each of the primary and secondary resistance tubes (more generally "elastic bands") may be one of multiple resistance strengths. The secondary resistance tube is generally a far higher degree of resistance than the primary resistance tube, as the role of the secondary resistance tube is to maintain the tautness of the primary resistance tube through both the extension (simulated in-water) portion of the rowing stroke and also through the return (simulated in-air) portion of the rowing stroke. Particularly, during the downward motion of the simulated in-air portion of the rowing stroke, when the tension on the primary resistance tube is being released (slackens), the secondary resistance tube maintains the primary resistance tube in a state of tautness so it does not go slack even as the hand-held ends of the primary resistance tube reach their closest point to the planar base board surface of the exercise machine at the point in the stroke that transitions from a downward movement (the end of the in-air motion of the rowing stroke) to an upward movement (the beginning of the simulated in-water motion of the rowing stroke).

Each quick release slot allows for removal, replacement and reconfiguration of the primary resistance tube relative to both the user and relative to the secondary resistance tube.

The multiplicity of fixed attachment points for the secondary resistance tube to the legs of the underside of the planar base board provide for the secondary resistance tube to be located closer or farther from the quick release slots thereby either lengthening or shortening the primary resistance tube for purposes of taller/shorter users and longer/shorter stroke motion and increased resistance of the primary resistance tube. Further, by attaching the ends of the secondary resistance tube in positions not directly opposite each other, the angle of the secondary resistance tube is configurable to be consistent with a starboard or port side single oar rowing strong configuration of the primary resistance tube whereby both ends of the primary resistance tube are run through the same quick release slot.

Each quick release slot incorporates a wide opening at the outer portion of the slot that narrows progressively to a neck area that opens into a circular area which has asymmetrically rounded edges above and below, wherein the edges nearest the opposing quick release slot have deeper and wider rounded edges creating a convex channel for the resistance tube. The rounded edges, and their asymmetry, reduce the amount of wear on the resistance tube.

Further, the ease of motion of the looped resistance tube that allows free movement of the tube along its length reduces the amount of time any one portion of the looped resistance tube is in contact with these areas of the internal circular area of the quick release slots. The narrower neck inhibits the resistance tube from slipping out of the circular area of the quick release slot, which neck is designed to be of a width near, at or smaller than the diameter of a resistance tube when the tube is not stretched. The wider external opening of the quick release slot allows for easy insertion of a resistance tube towards the neck, and then by stretching a resistance tube (which effectively narrows the diameter of the tube) allows easy insertion past a neck (choke point) and into an open, free movement circular area of a quick release slot.

The portions of the surfaces of the quick release slots that contact the primary resistance tube during a rowing stroke may be covered in a teflon or other friction-reducing paint or other surface material.

It will be noted by those persons of ordinary skill in the art that the various components that comprise the inventive portable exercise apparatuses described herein may each be implemented using any of several known off-the-shelf components. For example, the planar surface component and the front and back feet may be constructed of plywood, solid wood, metal, plastics or combinations thereof or other appropriate materials. Also, for example, the resistance elastic bands (e.g. tubes) may be in the form of a hollow tube, a band or other form and may be constructed of elastic latex, rubber or other stretchable materials with appropriate resistance properties, and may include sleeves surrounding the length of one or both of the primary and secondary resistance tubes to decrease frictional wear upon the elastic bands. The ends of the tubes may include fixed and/or detachable handles of various designs.

Additionally, for example, the front and back feet may be each a single molded or cut component, may comprise a single component comprising a front and back foot and may be constructed as a single molded component with the inclined planar surface. The exact locations of each of the feet components in relation to the inclined planar surface and in relation to the quick release slots may vary depending on the choice of design of each of the components or the choice of manufacturing option such as a single molded piece. Additionally, various companies can be utilized to outsource the fabrication and assembly of components.

Figure 4:
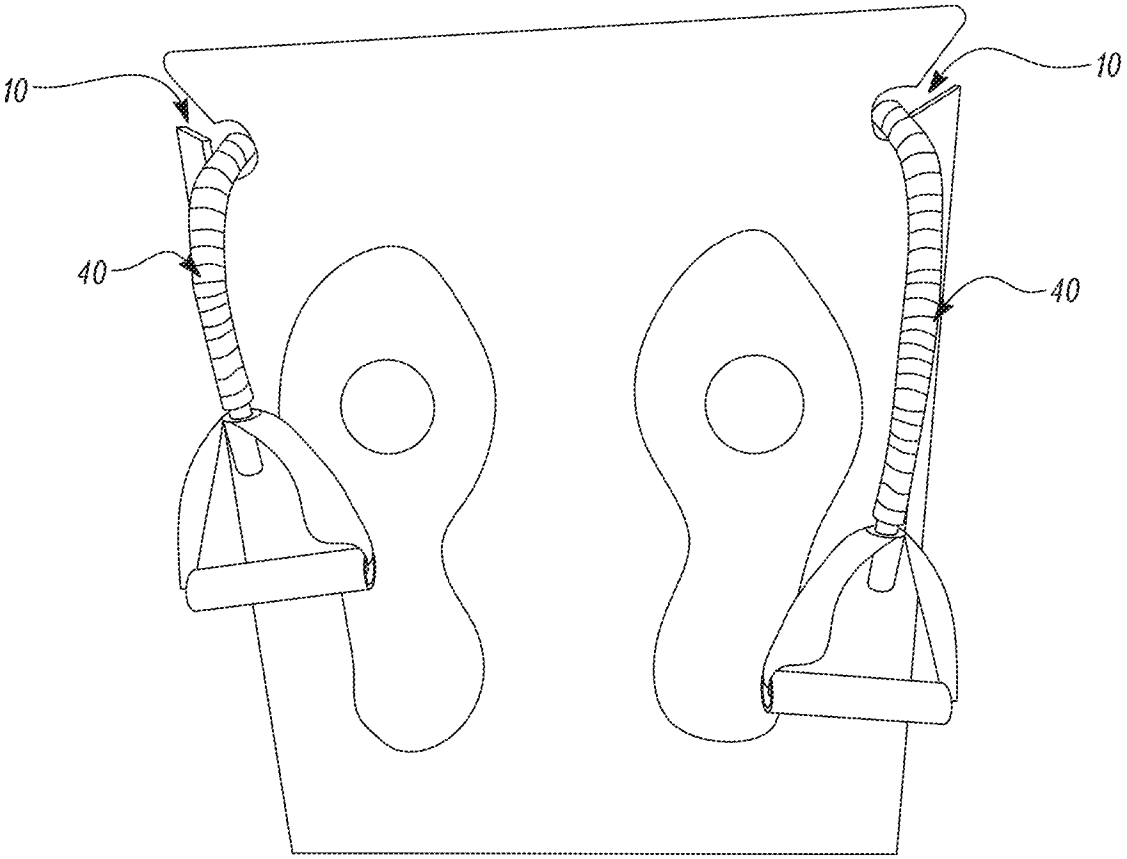
FIG. 4 depicts a front view similar to FIG. 3 wherein a pull cord is positioned such that one end is longer at the front than the other end.

FIG. 4 is a top view of the illustrative example of the invention showing the primary resistance tube 40 looped through the back centering component 30 and secondary resistance tube 50 such that the two handles of the primary resistance tube 40 are at different lengths at the top of the planar base board.

Figure 5:
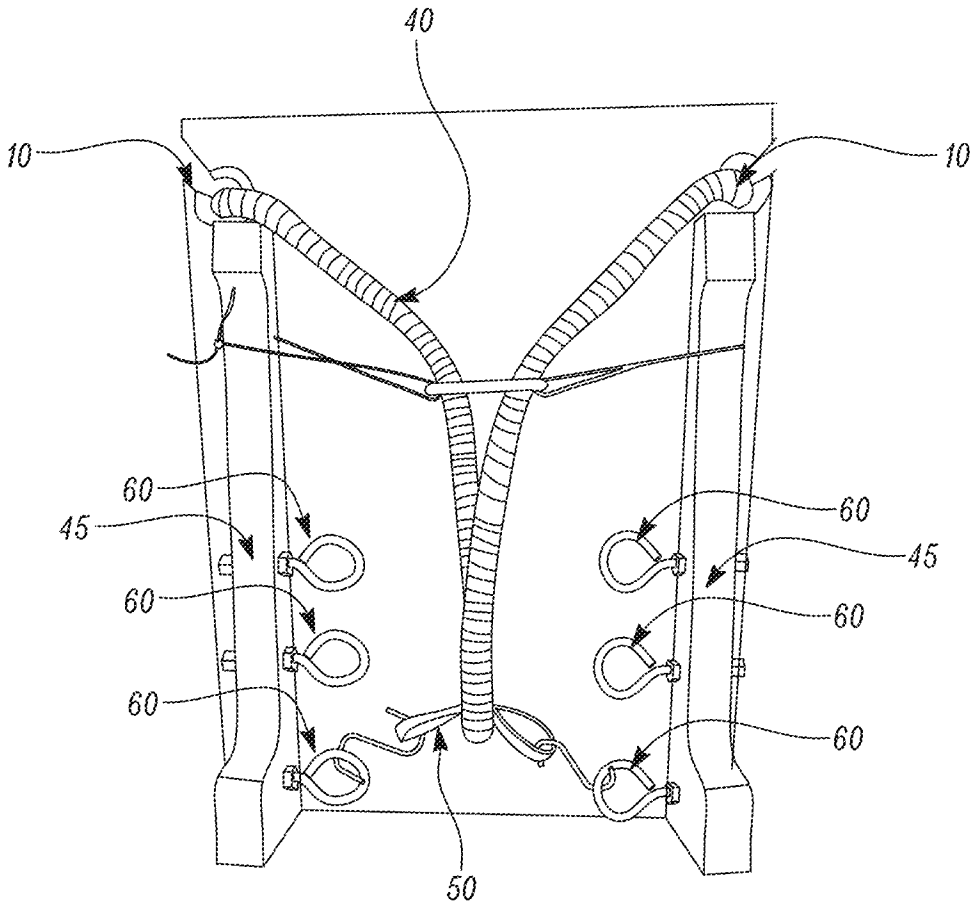
FIG. 5 depicts a back view of a planar, portable exercise apparatus with a focus on a re-positionable secondary retraction cord.

FIG. 5 is a back view of the illustrative example of the invention showing the primary resistance tube 40: (1) running from the front side to the back via each end of the primary resistance tube 40 passing through the two quick release slots 10, (2) running through the centering component 30, and (3) looping around the center of the secondary resistance tube 50. Additionally, a set of six attachments points 60 for each end of the secondary resistance tube 50 is shown, with three of the attachment points 60 being positioned along an inside length of the set of legs 45 of the planar surface of the base 20. The two ends of the secondary resistance tube 50 are shown detachably hooked to the two attachment points 60 located farthest from the corners of the base where the quick release slots 10 are located, thereby providing the maximum primary tension on the primary resistance tube through both the in-water and in-air portions of each rowing stroke.

Figure 6:
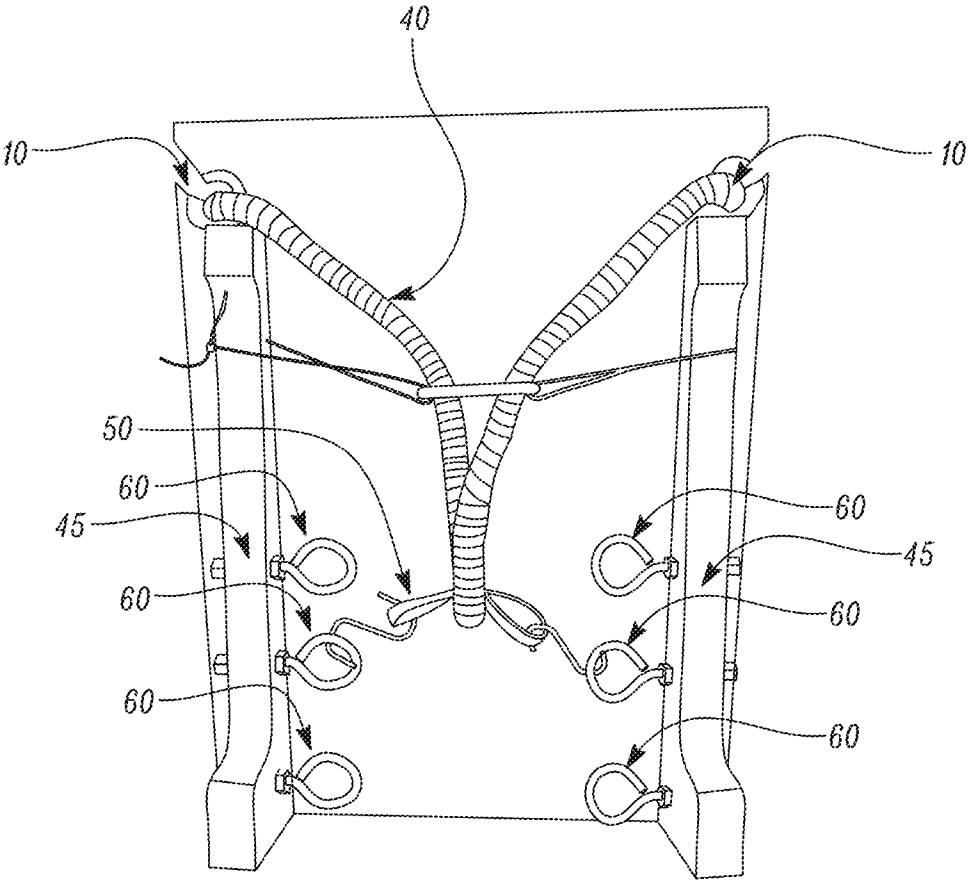
FIG. 6 depicts a back view similar to FIG. 5 wherein a secondary retraction cord is positioned farther towards the primary retraction cord than in FIG. 5.

FIG. 6 is a similar view to FIG. 5 except that: (1) the two ends of the secondary resistance tube 50 are shown detachably hooked to a different two of the attachment points 60 located laterally from each other at the second round of attachment points 60, thereby providing a medium level of tension on the primary resistance tube through both the in-water and in-air portions of each simulated rowing stroke using the illustrative rowing exercise machine depicted in the figures.

Figure 7:
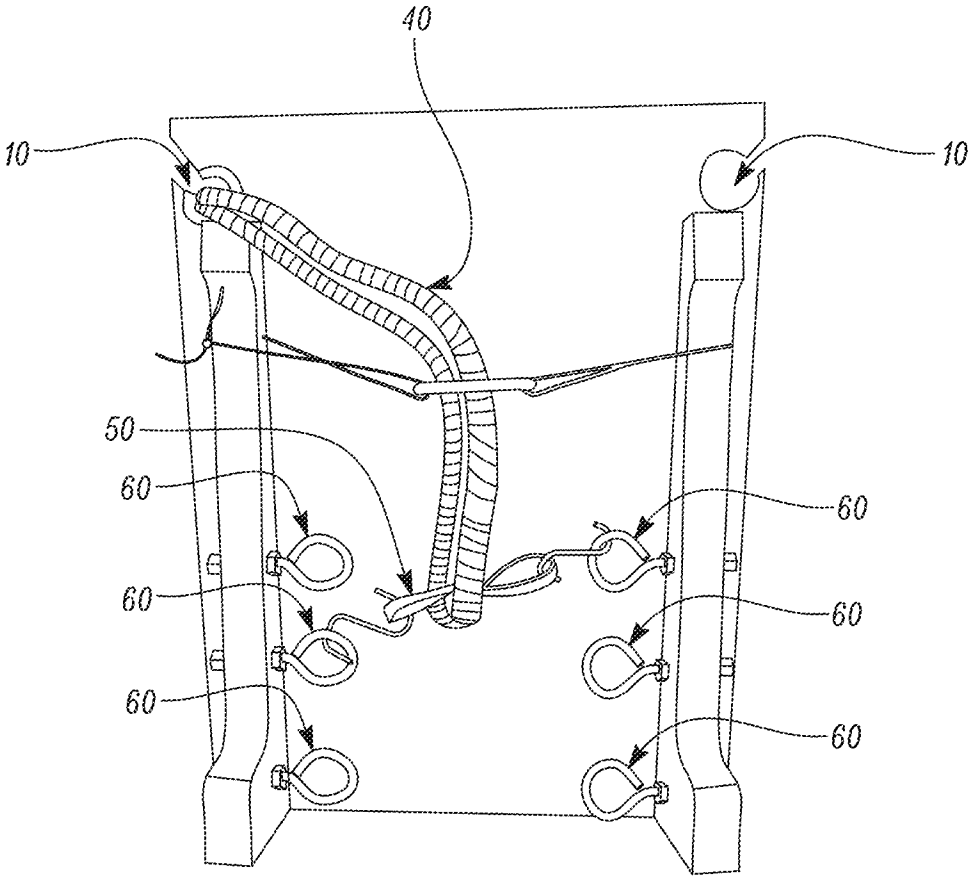
FIG. 7 depicts a back view similar to FIG. 6 wherein the selected attachment points of the secondary retraction cord are staggered for optimizing a specific orientation of a primary retraction cord for an exercise.

FIG. 7 is a back view of the illustrative example of the invention showing the primary resistance tube 40 running from the front side to the back via each end of the primary resistance tube passing through the same quick release slot 10, running through the centering component and looping around the center of the secondary resistance tube 50. Additionally, six attachments points 60 for each end of the secondary resistance tube are shown, with three each along the inside length of the feet/leg 45 of the underside of the planar surface base. The two ends of the secondary resistance tube 50 are shown detachably hooked to two of the attachment points 60 such that the the secondary resistance tube is held angled with respect to the quick release slot 10 where both ends of the primary resistance tube 40 are slotted. By running both ends of the primary resistance tube 40 through a same quick release slot 10 instance, the handles at each end of the primary resistance tube and the motion and resistance of the primary resistance tube simulate a double-handed, single oar "sweep" motion (as opposed to either a sculling or a double-handed straight-on rowing stroke motion). In this FIG. 7's instance, by positioning both ends of the primary resistance tube through the selected quick release slot, the rower experiences a starboard side "sweep" rowing stroke. By angling the secondary resistance tube as shown, the starboard side resistance of the primary resistance tube is enhanced and provides an intermediate additional tension between the first and second rungs of the fixed attachment points 60.

Figure 8:
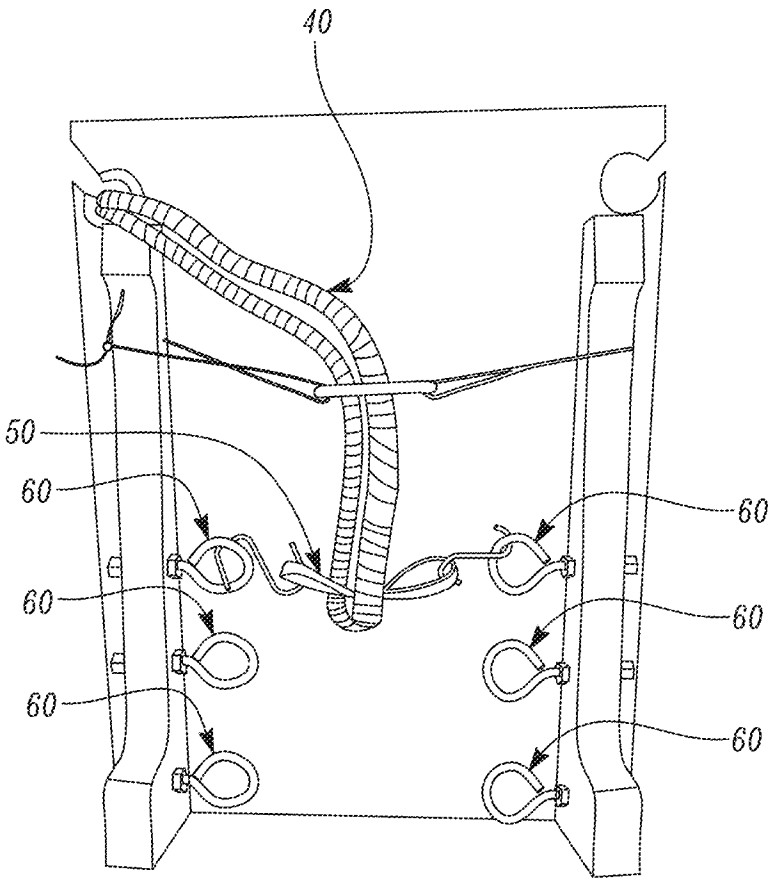
FIG. 8 depicts a back view of a further alternative of FIG. 7.

FIG. 8 is a backside view of the illustrative example of the invention showing the primary resistance tube 40 running from the front side to the backside via each end of the primary resistance tube passing through the same quick release slot 10, running through the centering component, and looping around the center of the secondary resistance tube 50. Additionally, the set of six attachment points 60 for each end of the secondary resistance tube 50 are shown, with three attachment points each along the inside length of the feet/leg 45 of the planar surface base. The two ends of the secondary resistance tube 50 are shown detachably hooked to two of the set of attachment points 60 such that the secondary resistance tube 50 is held at an angle with respect to the quick release slot 10 where both ends of the primary resistance tube are slotted. In the FIG. 8 example, by positioning both ends of the primary resistance tube through the selected quick release slot 10, the user of the rowing exercise apparatus experiences a port side "sweep" rowing stroke. By positioning the secondary resistance tube 50 as shown to the first rung of the set of fixed attachment points 60, the port side resistance of the primary resistance tube 40 is at its least (lowest/easiest level of) resistance setting (and provides the longest reach of the primary resistance tube 40).

Figure 9:
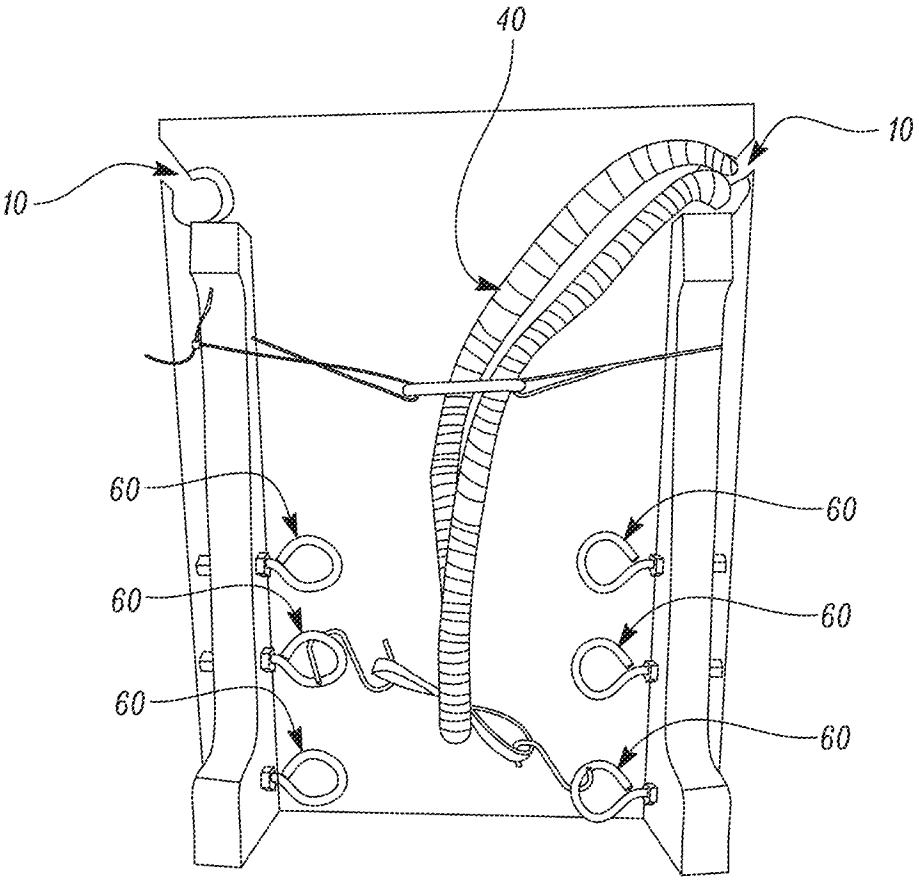
FIG. 9 depicts a back view of a further alternative of FIG. 7.

FIG. 9 is a back/underside view of the illustrative example of the invention showing the primary resistance tube 40 running from the frontside to the backside via each end of the resistance tube 40 passing through the same quick release slot 10, running through the centering component 30 and looping around the center of the secondary resistance tube 50. Additionally, the set of six attachments points 60 for each end of the secondary resistance tube are shown, with three attachment points each, of the set of six attachment points 60, along the inside length of the feet/leg 45 of the planar surface base 20. The two ends of the secondary resistance tube 50 are shown detachably hooked to two of the attachment points 60 such that the secondary resistance tube 50 is held angled with respect to the quick release slot 10 where both ends of the primary resistance tube 40 are slotted. In the example provided in FIG. 9, by positioning both ends of the primary resistance tube 40 through the selected quick release slot 10, the user of the rowing exercise apparatus experiences a port side "sweep" rowing stroke. By positioning the secondary resistance tube 50 as shown to the second and third rungs of the set of fixed attachment points 60, the port side resistance of the primary resistance tube 40 is at its close to its highest (most rigorous level of) resistance setting (and provides close to the shortest reach of the primary resistance tube 40).

Figure 10:
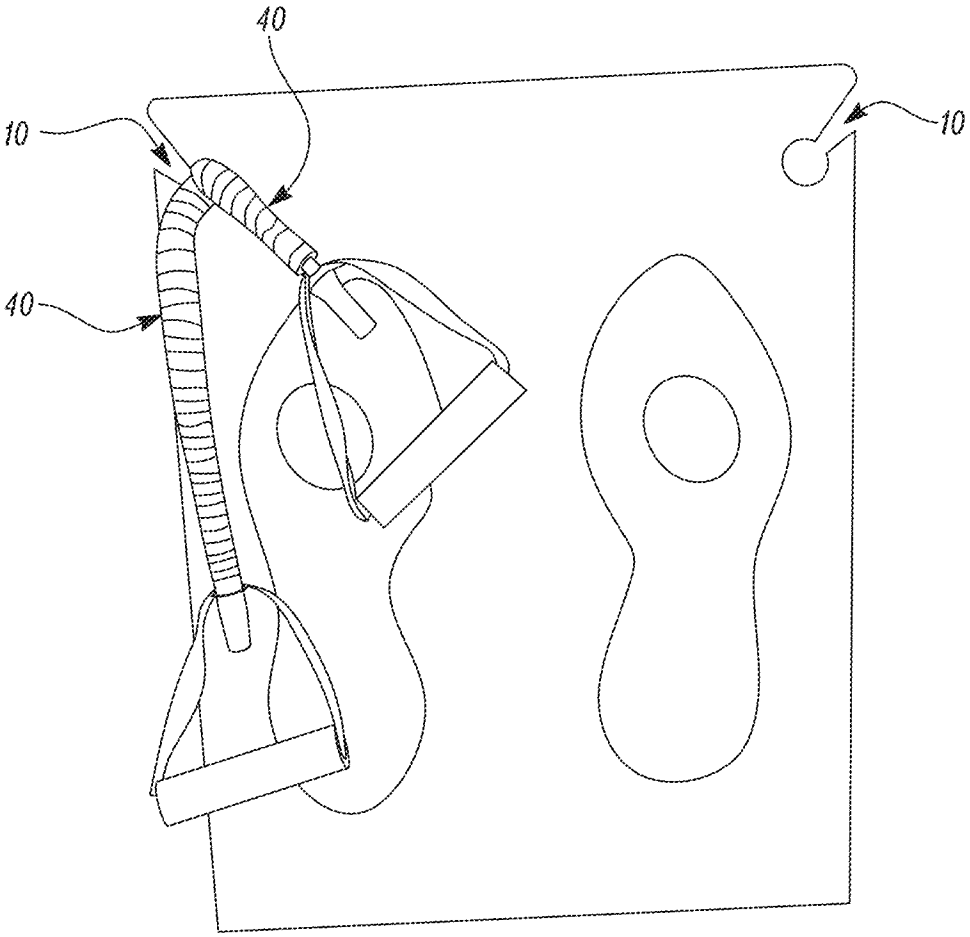
FIG. 10 depicts a front view of the implementation depicted in FIG. 9.

FIG. 10 shows the front view of the illustrative example of the invention in relation to the backside settings depicted in FIG. 9. The front (handle) ends of the primary resistance tube 40 are run through the same, starboard side quick release slot 10. The starboard side is determined by facing the bow of the boat, which, for purposes of this illustrative example, is towards the heels of the foot imprints shown because rowers face the stern of a boat when they are rowing. Furthermore, the user of the rowing exercise apparatus has slid the loop of the primary resistance tube 40 through the backside centering component 30 and around the secondary resistance tube 50 such that the outboard handle end (the left hand for a starboard sweep) is longer and the right hand handle end is shorter. By sliding the primary resistance tube loop to effectuate this differential in handle positions at the start of the in-water stroke (handles nearest to the planar surface and above the toes), the rowing exercise apparatus properly additionally simulates the arc of motion throughout the in-water portion of the stroke from the catch to the finish and through the recovery (in-air portion) back to the catch for a starboard sweep rowing stroke.

Figure 11:
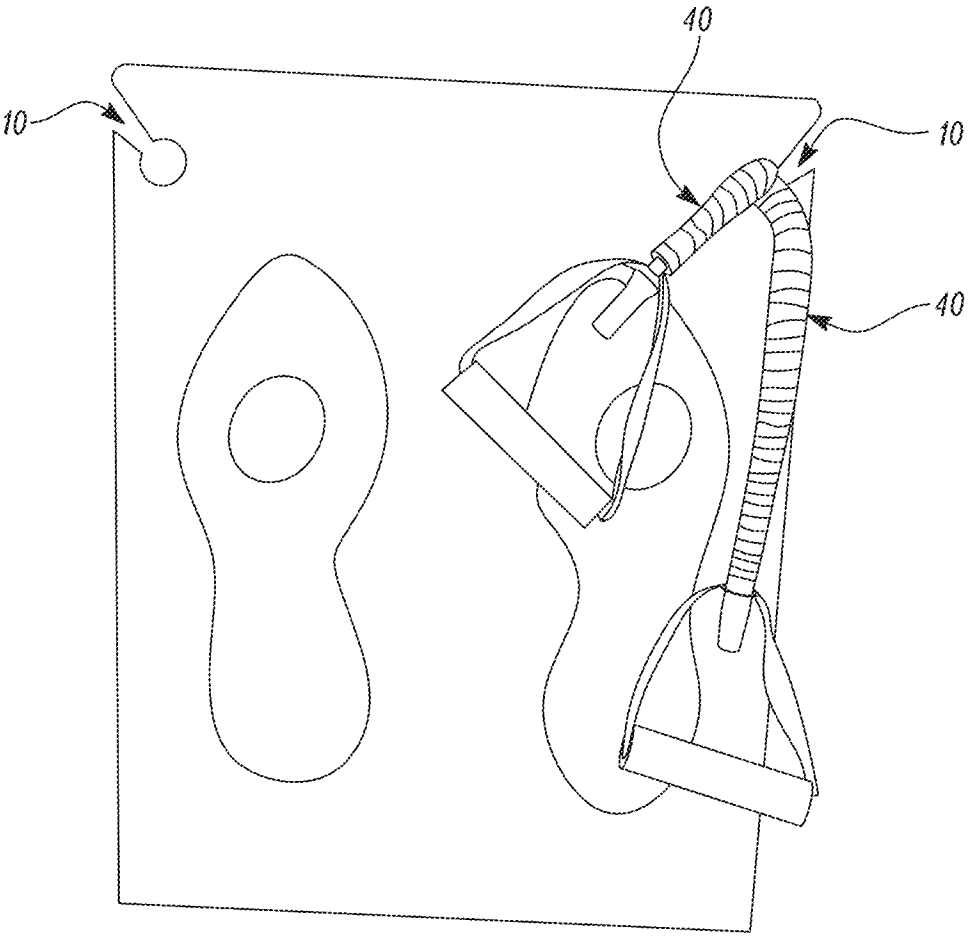
FIG. 11 depicts a front view of the implementation depicted in FIG. 7.

FIG. 11 shows the front view of the illustrative example of the invention in relation to the backside settings depicted in FIG. 8. The front (handle) ends of the primary resistance tube 40 are run through the same, port side quick release slot 10. The port side is determined by facing the bow of the boat, which, for purposes of the illustrative examples of the invention, is towards the heels of the foot imprints shown because rowers face the stern of a boat when they are rowing. Furthermore, the user of the rowing exercise apparatus has slid the loop of the primary resistance tube through the backside centering component 30 and around the secondary resistance tube 50 such that the outboard handle end (the left hand for a port sweep) is shorter and the right hand handle end is longer (meaning that at the "catch" of the stroke, the right hand is closer to the body of the rower, and the left hand is extended farther). By sliding the primary resistance tube loop to effectuate this differential in handle positions (the inboard hand on the "oar" handle reaches farther around at the start of the in-water phase (the "catch") of the rowing stroke in order to position the blade of the oar for a long in-water pull through to the finish of the stroke) at the start of the in-water stroke (handles nearest to the planar surface and above the toes), the rowing exercise apparatus properly additionally simulates the arc of motion throughout the in-water portion of the stroke from the catch to the finish and through the recovery (in-air portion) back to the catch for a port-side sweep rowing stroke.

FIGS. 8-11, in summary, depict how illustrative examples of the invention provide the user with a selection of: (1) mirror image starboard and port-side single oar sweep rowing strokes comparable to actual rowing shells with starboard and port sweeps; (2) the usual rowing machine straight-on rowing stroke motion, and (3) the sculling rowing stroke motion depicted enabled in selected earlier Figures.

Turning to a rower swing/support structure of a convertible and re-configurable exercise machine aspect of the disclosure FIGS. 12 to 21, in summary, depict illustrative examples of the invention wherein a swinging seat structure is added, and how the aforementioned planar surface invention is utilized for the oar handle/retraction system. However, this swinging seat system can be alternatively integrated/reconfigured with a fan-based and/or magnetic resistance oar handle/retraction system. Further, while not shown in the figures, the disclosed systems may incorporate and/or be used in association with an integral display/tv/monitor for viewing training sessions or videos or other media while exercising and/or a separate or integrated monitor for tracking the user's exercise regimen's statistics, such as stroke count, calories burned, distance rowed, heart beat and other standard and non-standard statistics and visual depictions of physical exercise-related parameters associated with exercise machines.

Further, while not shown in the figures, illustrative examples of the invention include sensors/electronics facilitating carrying out measuring the lateral motion of the seat throughout the stroke, thereby providing a critical dimension to inform and train a rower (and inform a rower's coach) of the likely on-water effectiveness of the rower. The capability for measuring lateral motion in the swing rower can be implemented in multiple ways, such as by embedding one or more multi-axis accelerometers in the seat assembly such that both the fore-and-after acceleration of the seat are measured throughout the stroke and reported and displayed on one or more monitors either wirelessly or through a wired connection or by monitoring the fore and aft and lateral motion at the swing joints where the seat assembly is moveably attached at its top to the overhead beam. The monitor(s) described earlier may provide/display graphical visualizations of the rower's body movement/body positioning throughout the stroke, thereby providing additional, important information and training resources to the user. Further, the data and graphical and visual displays may be integrated in a mobile app and stored and processed in whole or in part in the cloud, and made available to user across the user's devices, including, for instance smartphones, laptops, tablets, smart watches, heads-up displays and desktop computers.

Figure 12:
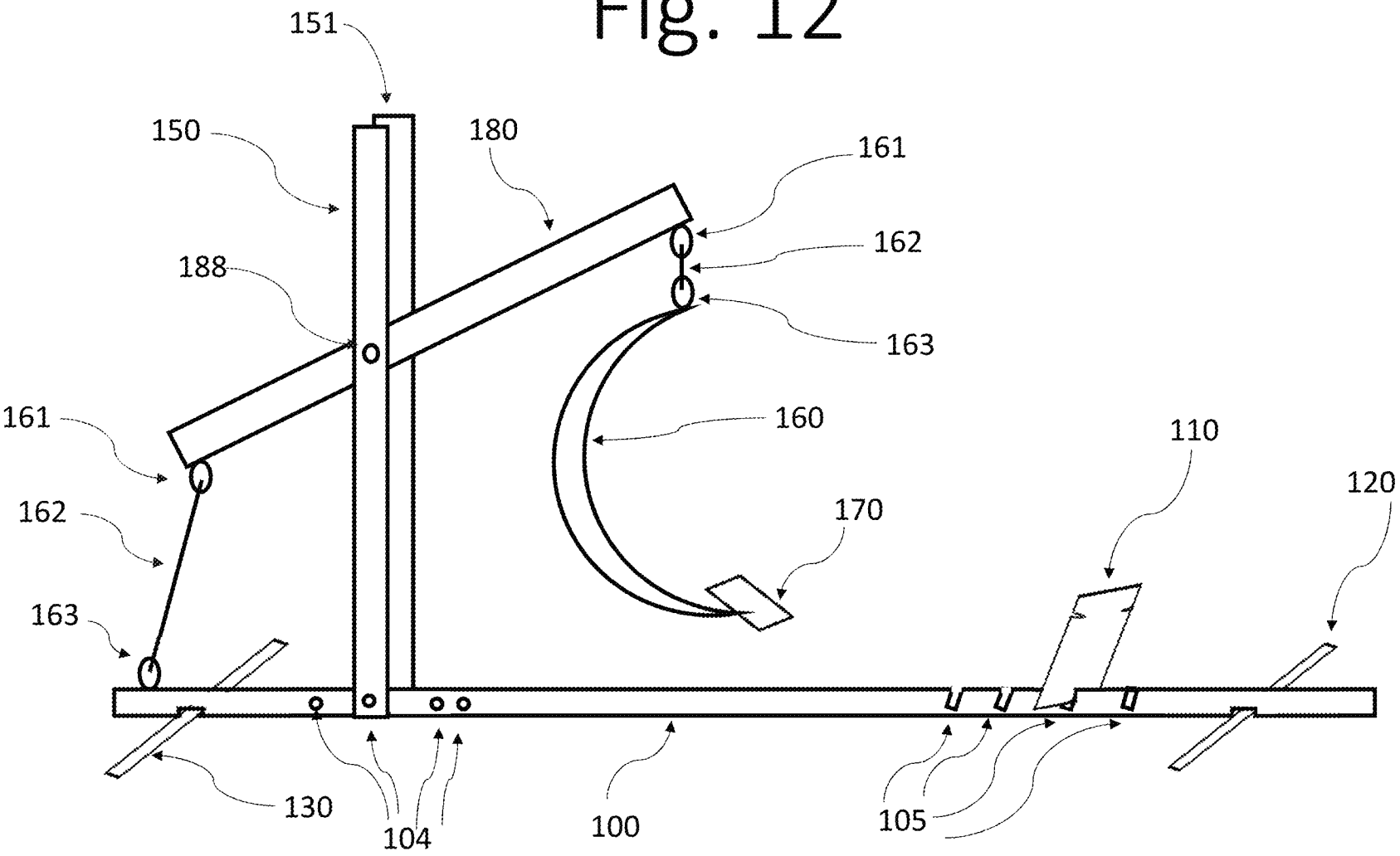
FIG. 12 depicts a side view of a swing seat assembly with the planar rowing surface described in earlier Figures attachably implemented.

FIG. 12 shows a side view of an entire swing-seat rowing machine, in accordance with an illustrative example, wherein the seat 170 is integrally attached to an arched beam 160, the top of which is hung from an angled beam 180. The arched beam 160 is curved such that a rower can lean back at the end of a stroke without hitting the beam with the rower's upper back or head. Further, the seat 170 and arched beam 160 swing forward and back allowing the rower the full leg, arm and back extension from the start of a stroke with knees bent and arms out to the end of the stroke with the rower's legs extended, their back leaning away from the oar and their arms retracted. In this way, the seat does not have any friction from the weight of the rower pushing the seat down while the seat moves forward and back along a beam or a set of tracks. Additionally, in this way, if the rower shifts their weight off center at any time during the stroke, the seat will (trackably) swing side-to-side, thereby impairing the power and efficiency of the stroke and training the rower to be an effective rower on the water.

FIG. 12 further depicts that a height of the seat-end of the angled beam 180 can be raised and lowered by, for example, a rope assembly 162 with an attachment point 161 on the angled beam 160 and an second attachment point 163 on the base beam/rail 100, and a swivel point 188 on the vertical structural pieces 150, 151. The vertical structure pieces 150, 151 are positionable fore-and-aft along the base beam/rail 100 at points 104. The planar surface and oar retraction system 110 of the invention is moveably positionable at attachment points 105 along the base beam/rail. These attachment points (104, 105) allow rowers of various heights and leg lengths to optimally configure the rowing system for their body type. The base beam/rail 100 includes horizontal stabilizers 120, 130.

Figure 13:
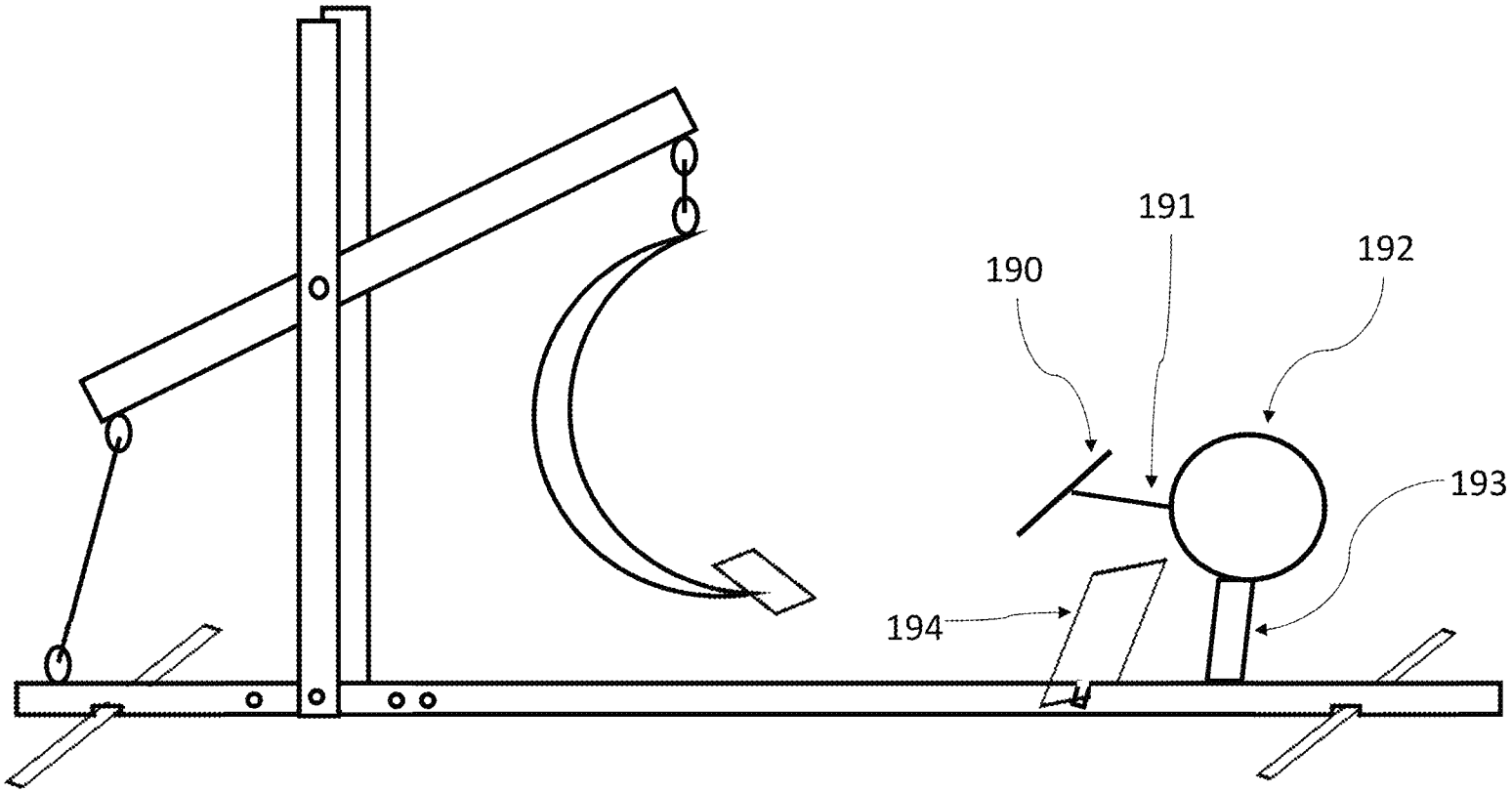
FIG. 13 depicts a side view of an alternative swing seat assembly.

FIG. 13 depicts an illustrative example where the swing rower of FIG. 12 with the planar surface foot/oar retraction system replaced by a standard fan and/or electro-magnetic tension/resistance component 192, with an oar handle 190 and a retractable belt/chain 191, and a structural component 193 for positioning and containing related components of the tension/retraction system. In this implementation, the component 194 for placing and holding the rower's feet is a surface with straps and/or shoes for holding the feet in place.

Figure 14:
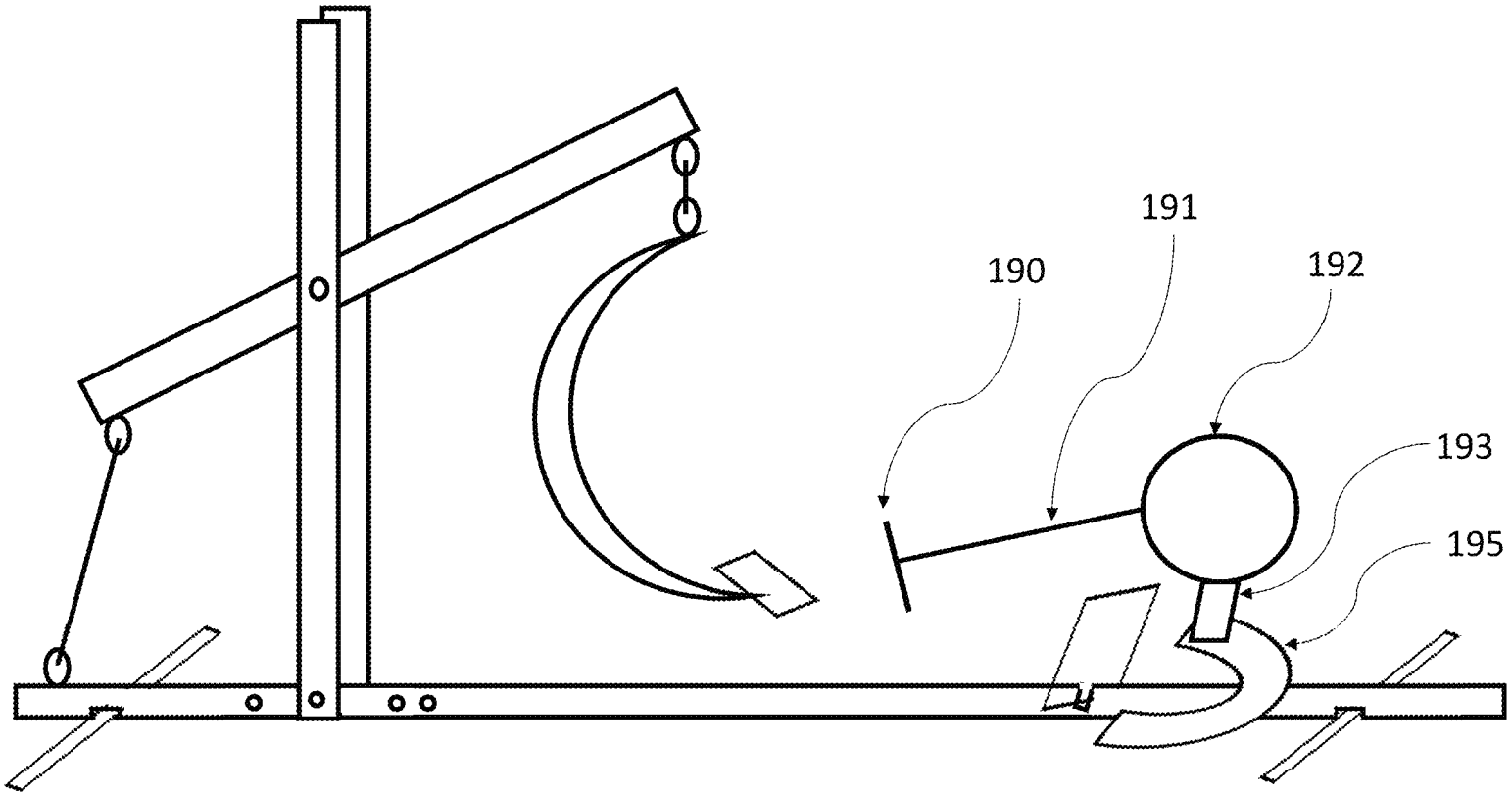
FIG. 14 depicts a side view of a further alternative implementation of the swing seat assembly.

FIG. 14 depicts an illustrative example of the invention of FIG. 13 wherein the tension/resistance structure 192, 193 is moveably attached to a structural component 195 that allows the tension/resistance structure 192, 193 to shift or swivel to port or starboard in addition to a center-line position, thereby allowing for an improved rowing training for rowers who row in boats on the water wherein each rower has either a single starboard-side or port-side oar. In FIG. 14, the tension/resistance structure 192, 193 is positioned for a starboard-side rowing stroke. In that context, current rowing machine designs that allow only for a straight forward/back pull of the oar directly along the center beam are failing to provide an accurate rowing experience and, hence, also mis-training rowers who use them.

Figure 15:
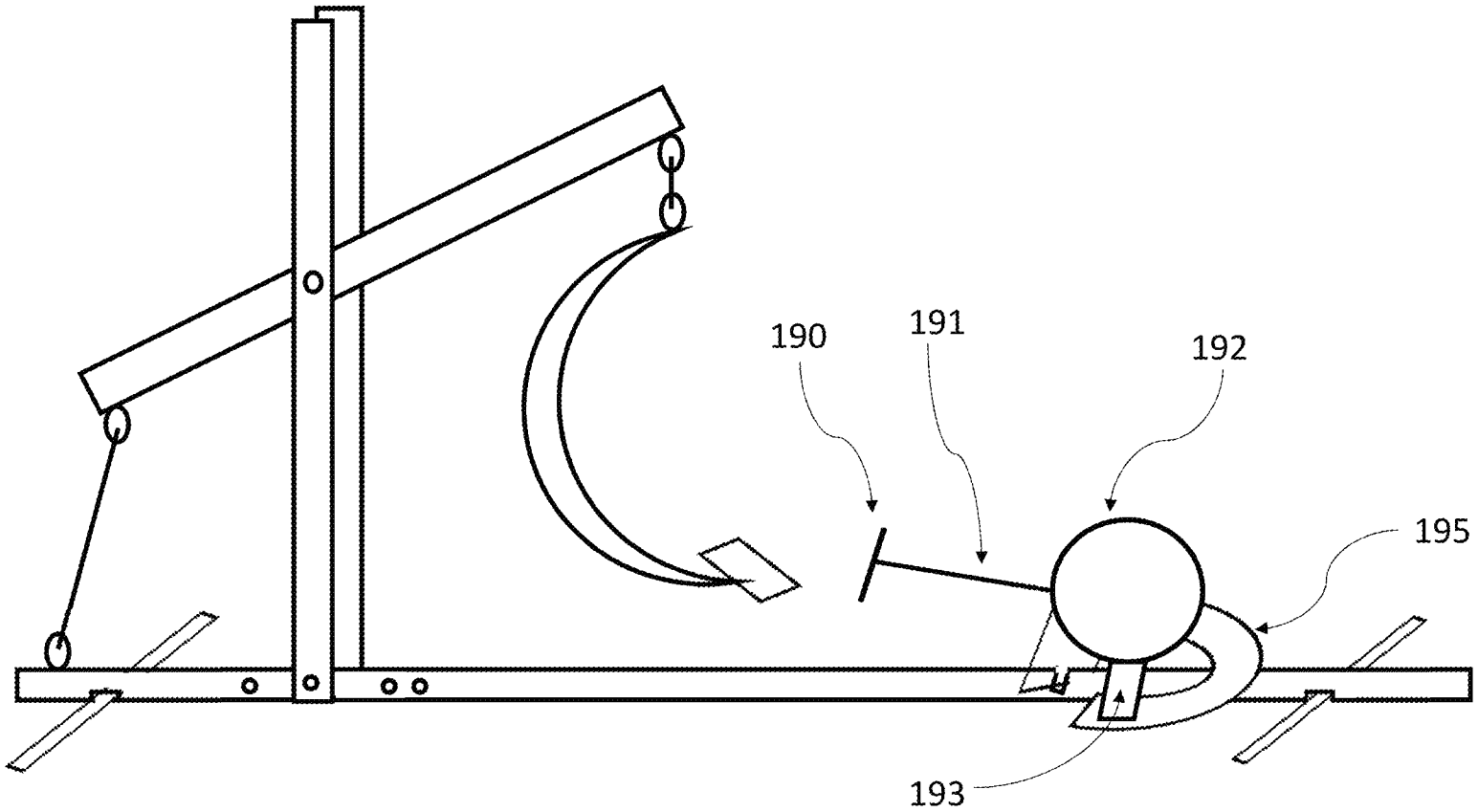
FIG. 15 presents an additional side view of FIG. 14.

FIG. 15 depicts the illustrative example of the disclosed apparatus of FIG. 14 wherein the tension/resistance structure is positioned for a port-side sweep rowing stroke.

Figure 16:
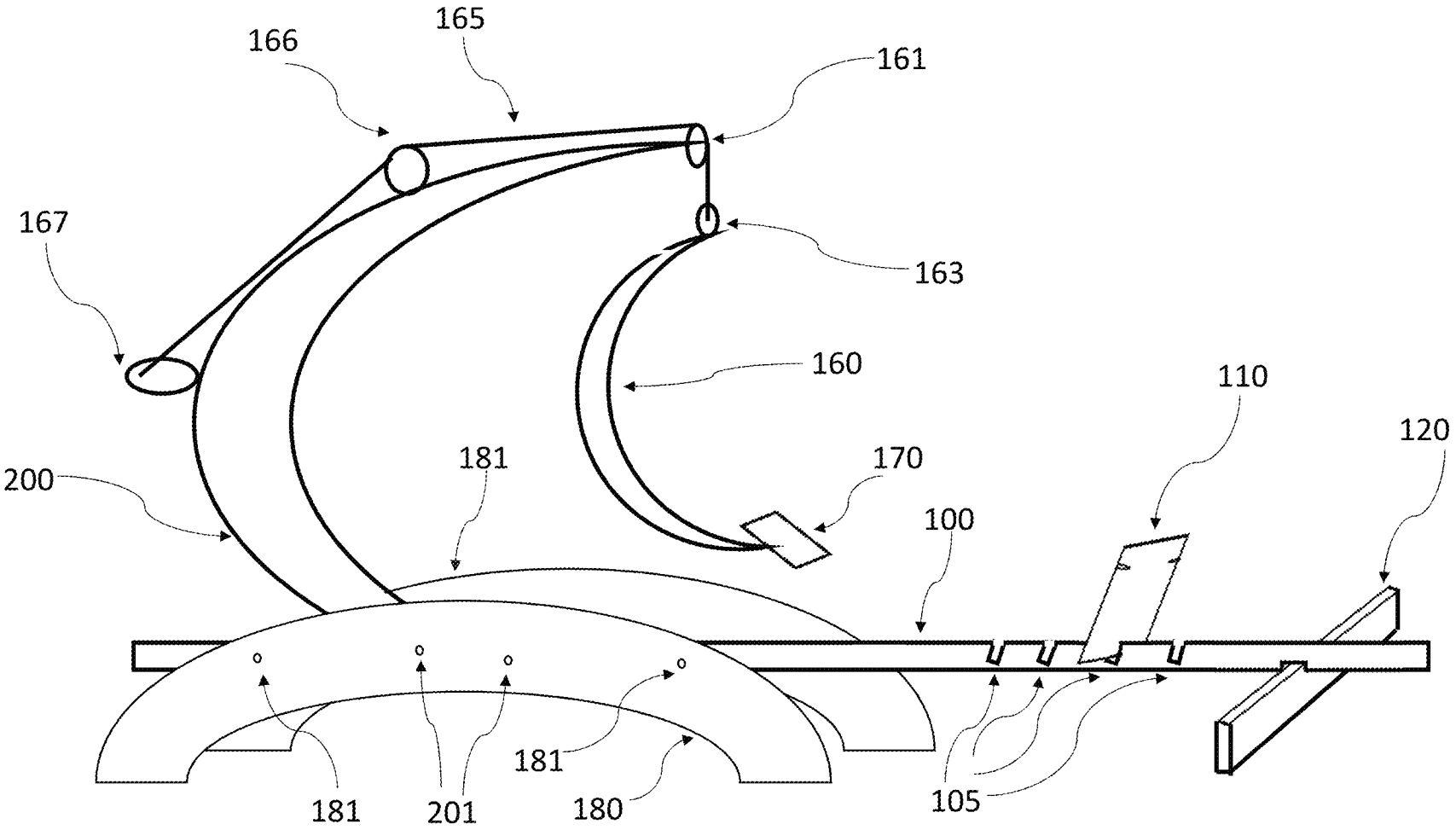
FIG. 16 depicts a side view with an alternate main structure of the swing seat assembly.

FIG. 16 depicts an alternative illustrative example of the initial illustrative example of the invention of FIG. 12 wherein a single arched structural component 200 replaces the combined vertical beams 150, 151 and the angled beam 180 depicted in FIG. 12. The single arched structural component 200 allows for a full swinging motion of the seat assembly 160, 170. Further, the height of the seat assembly is controlled by a block and tackle/pulley and rope system 163, 161, 165, 166, 167. Further, the horizontal stabilizer 130 of FIG. 12 is replaced by fore-and-after components on each side of the center beam/rail 100 and single arched component 200. These components are attached via cross-beams at 181 and 201. The arched structural component 200 may optionally be constructed integrally with the center beam/rail 100.

Figure 17A:
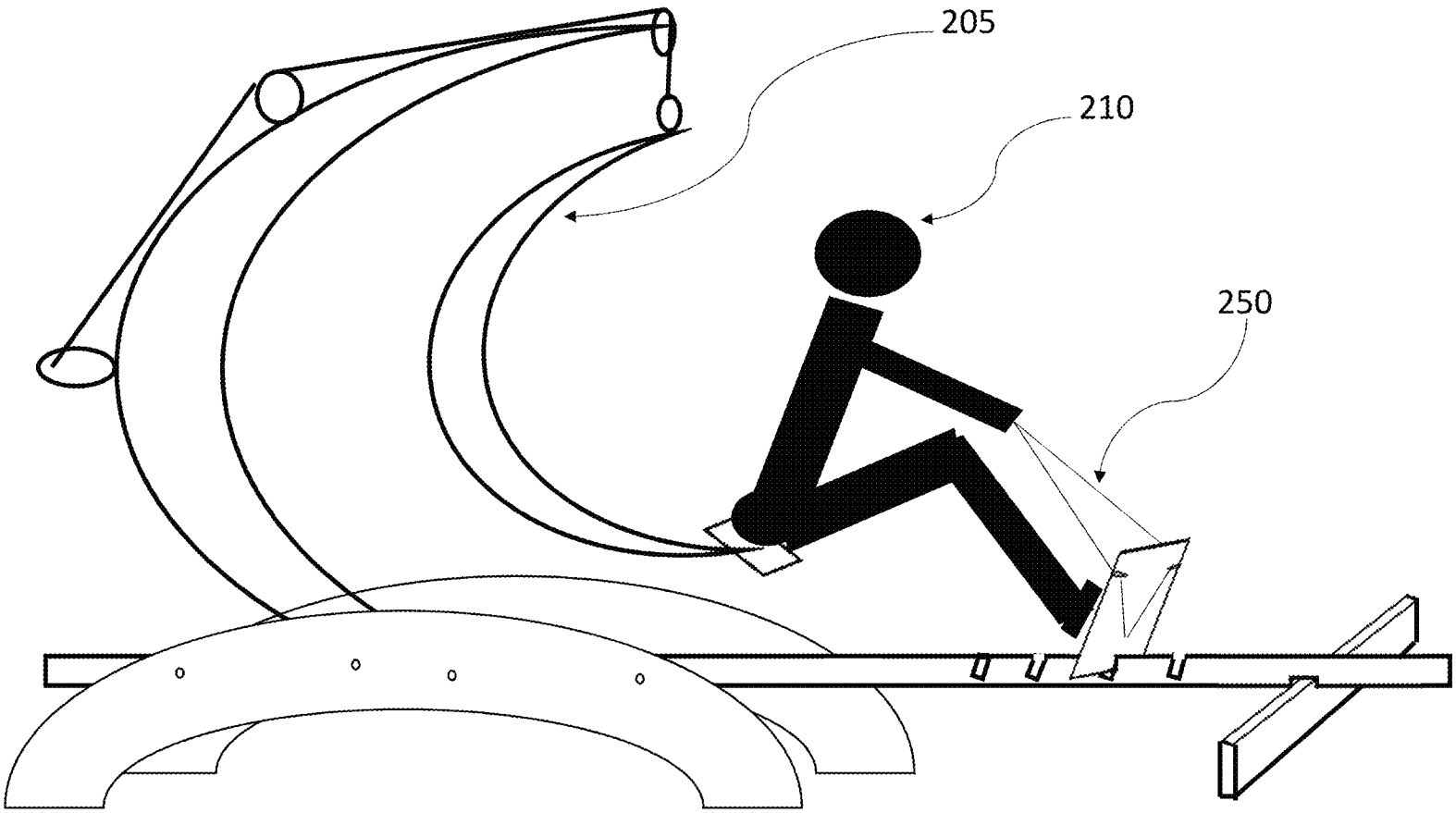
FIG. 17A depicts a side view of a swing seat assembly with the planar rowing surface described in earlier Figures and a schematic of a rower in a "catch" position of a rowing stroke.
Figure 17B:
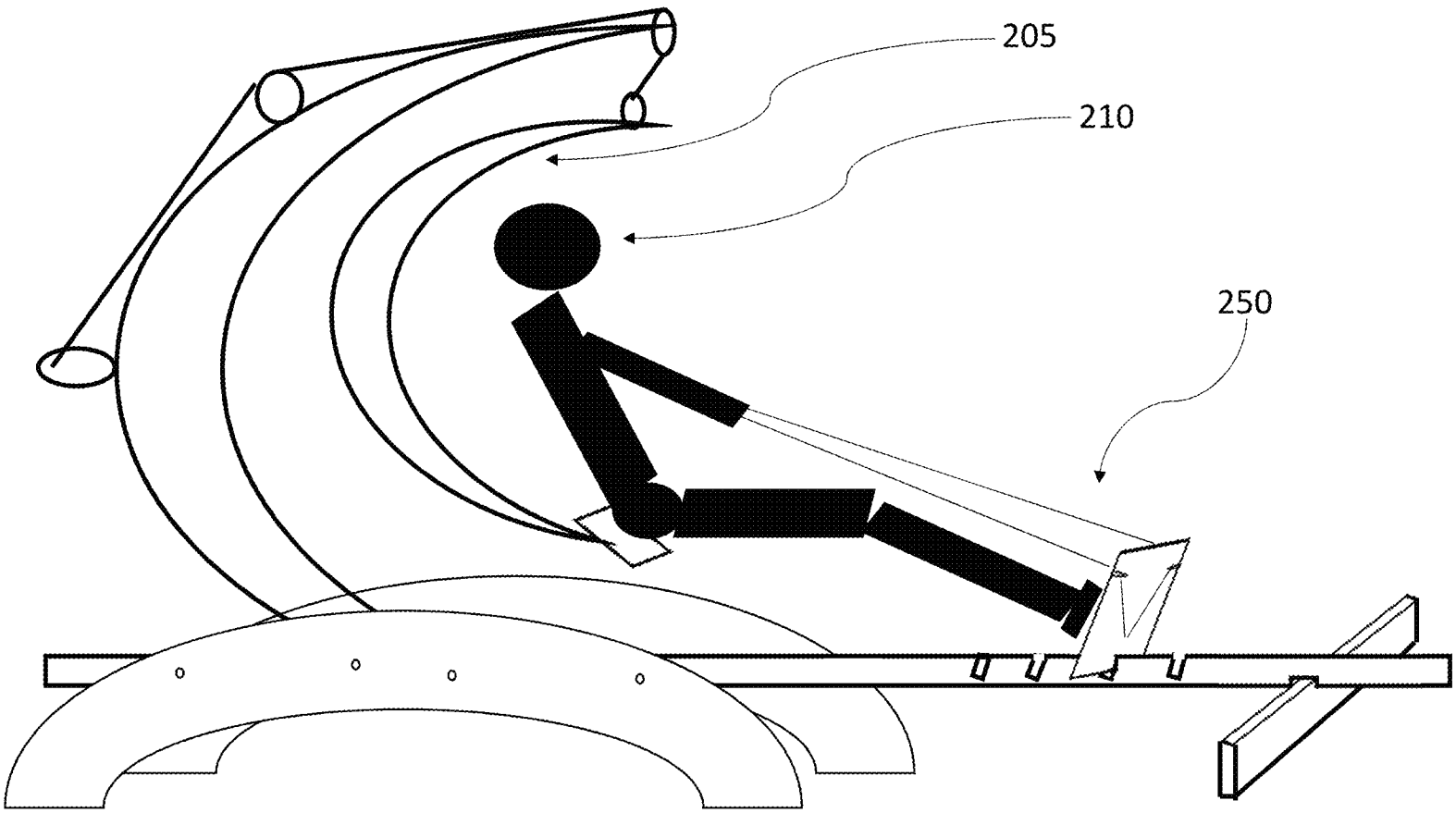
FIG. 17B depicts a side view of a swing seat assembly with the planar rowing surface described in earlier Figures and a schematic of a rower in a "finish" position of a rowing stroke.

FIG. 17A depicts another illustrative implementation of the invention of FIG. 16 with the likeness of a person 210 rowing wherein the rower is approximately positioned at or near the start of a rowing stroke, with a swing and seat assembly swung forward towards the rower's feet according to the rower's body positioning at that start point in the stroke, with the rower's knees bent, shoulders forward and arms reaching forward holding, in this illustrative example, a retractable band 250. The beam 205 that hangs from the swivel point above, to which the seat is attached at the bottom, is curved such that it supports (and does not interfere with) the rower's body positions throughout the rowing stroke, including the rower's body position at the start of the stroke as depicted in this FIG. 17A, and the rower's body position at the end of a stroke as depicted in FIG. 17B. For instance, at the end of a stroke, the rower's upper body is leaning back with the shoulders, back and head requiring allowance to move freely without interference by any portion of beam 205. The entire seat assembly, including the beam 205 and the seat, swing forward and back during each rowing stroke.

FIG. 17B depicts an illustrative alternative to the example of the invention of FIG. 16 with the likeness of a person 210 rowing wherein the rower is approximately positioned at or near the finish (end) of a rowing stroke, with a swing and seat assembly in a swung position away from the rower's feet according to the rower's body positioning at that end point in a rowing stroke, with the rower's knees extended, shoulders back and arms retracted holding, in this example, a retractable band 250.

Figure 17C:
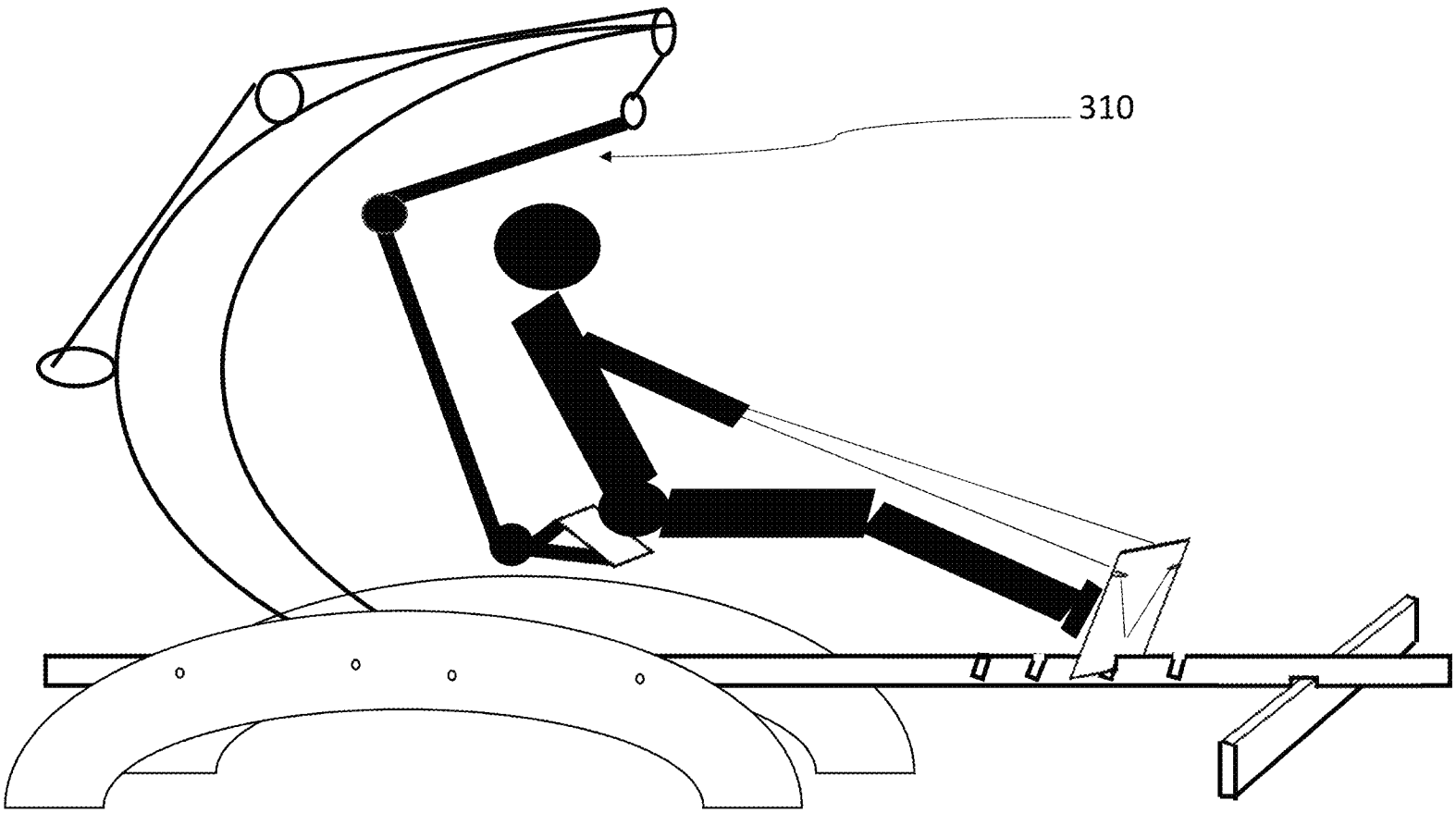
FIG. 17C depicts a side view of a swing seat assembly with the planar rowing surface described in earlier Figures and a schematic of a rower in a "finish" position of a rowing stroke with an hinged seat structure design.

FIG. 17C depicts another illustrative implementation of the previous example in FIG. 17B wherein a hanging swing assembly 310 is of a different configuration and structure than the swing assembly shown in FIGS. 12-16 discussed above.

Figure 17D:
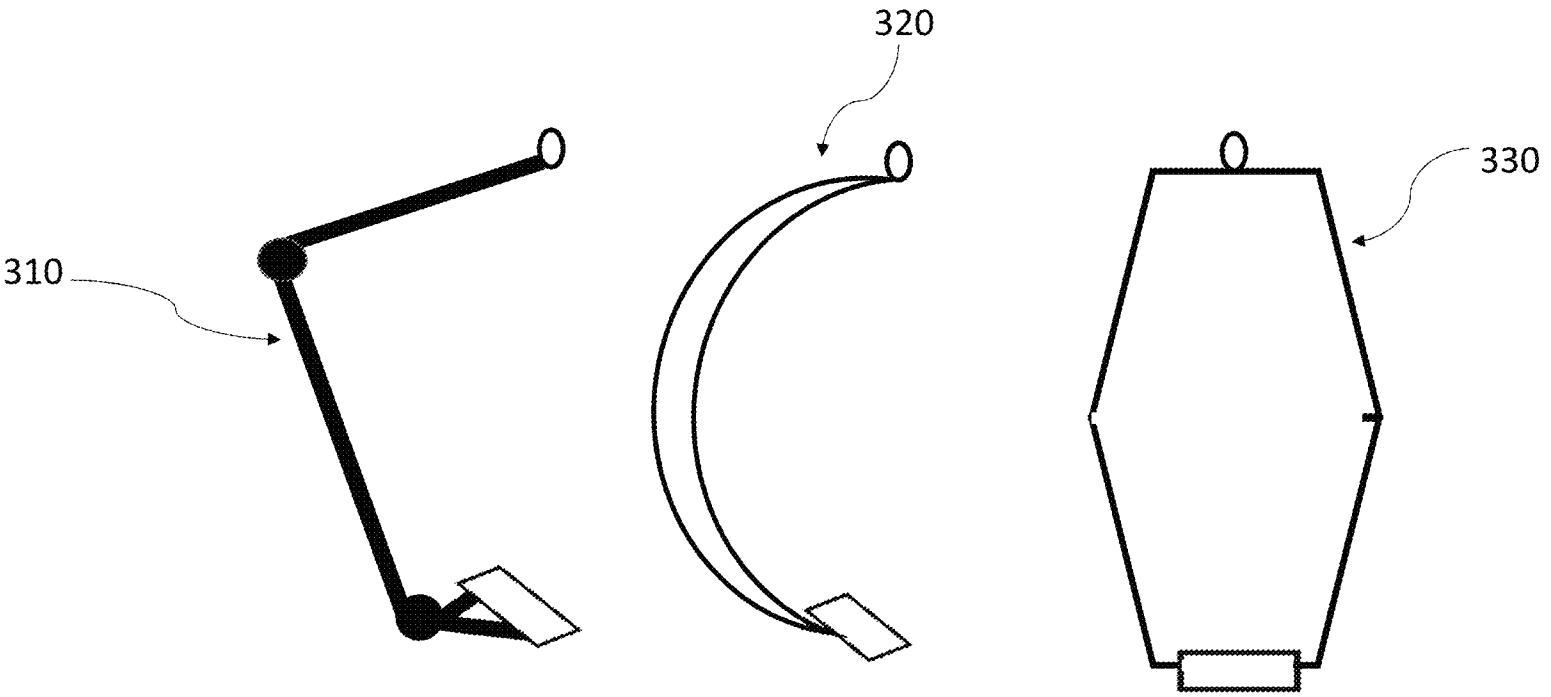
FIG. 17D depicts exemplary instances of seat structure designs in side and front views.

FIG. 17D depicts a set of three examples of the hanging swing illustratively depicted herein. In the illustrative examples, each of the swings is an interchangeable (by the user) hanging swing and seat assembly implementations 310, 320, 330. Swing and integral (or detachable/changeable) seat implementations 310, 320 are side views, whereas implementation 330 is a head-on view. As will be clear to a person experienced in hanging seat assemblies, multiple other implementations are available, the design and choice of which are dependent on the intended usage for any particular configuration and use of the system, such as, by way of example, for competitive or age-assisted or physical-therapy assisted rowing or bicycling and for large, medium or small dimensions of a person.

Figure 17E:
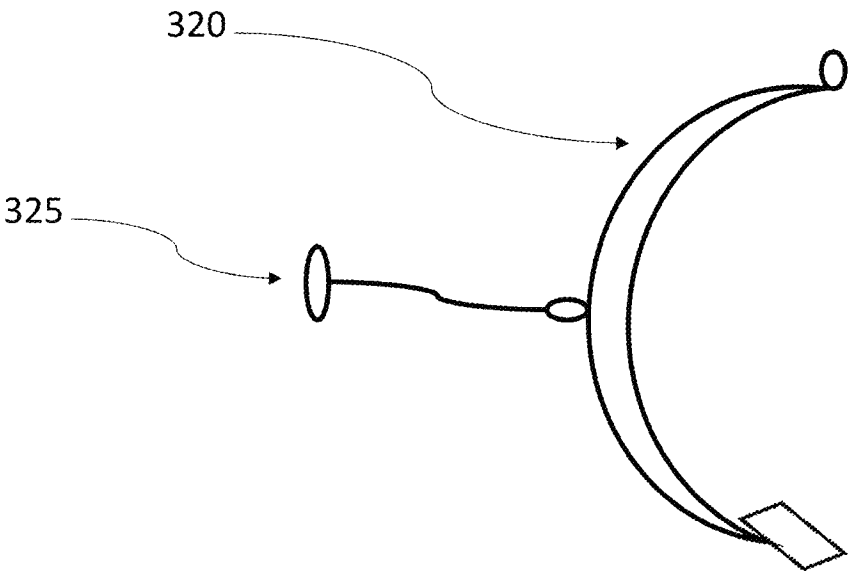
FIG. 17E depicts a side view of a seat structure assembly with a control handle system for assisted rowing.

FIG. 17E depicts a swing/seat assembly 320 with an attached swing-motion controller 325 whereby a physical therapist, trainer or other person can provide variable levels of assistance in the direction, extent and speed of the swing of the swing/seat assembly for multiple types of contexts, such as for physical therapy, training and age-assisted exercise.

Figure 17F:
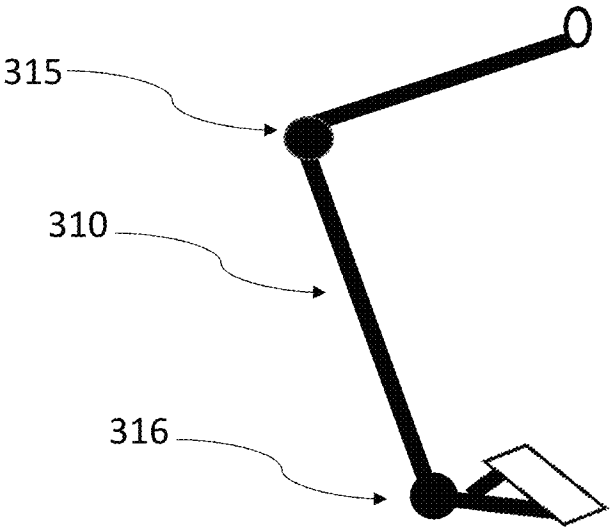
FIG. 17F depicts a side view of a hinged seat assembly structure.

FIG. 17F depicts a configurable swing/seat assembly 310 with ratcheting angle controls 315, 316 such that a swing assembly is re-configurable to accommodate different body types for different types and motions of exercises. For instance, a rower with a long upper body/torso might want a deeper space to lean back at the end of a stroke than a rower with a different body configuration.

Figure 17G:
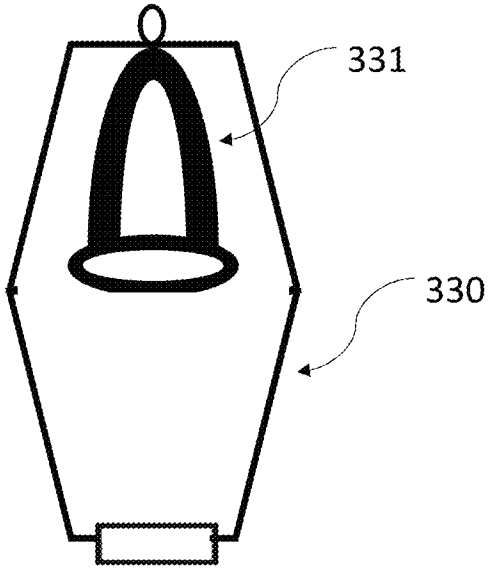
FIG. 17G depicts a front view of a seat assembly structure incorporating a harness system.

FIG. 17G depicts a swing/seat assembly 330 with a harness system (331) wherein the harness provides support for the positioning of an exerciser's body such as, for instance, during physical therapy, or age or illness-related exercising.

Figure 17H:
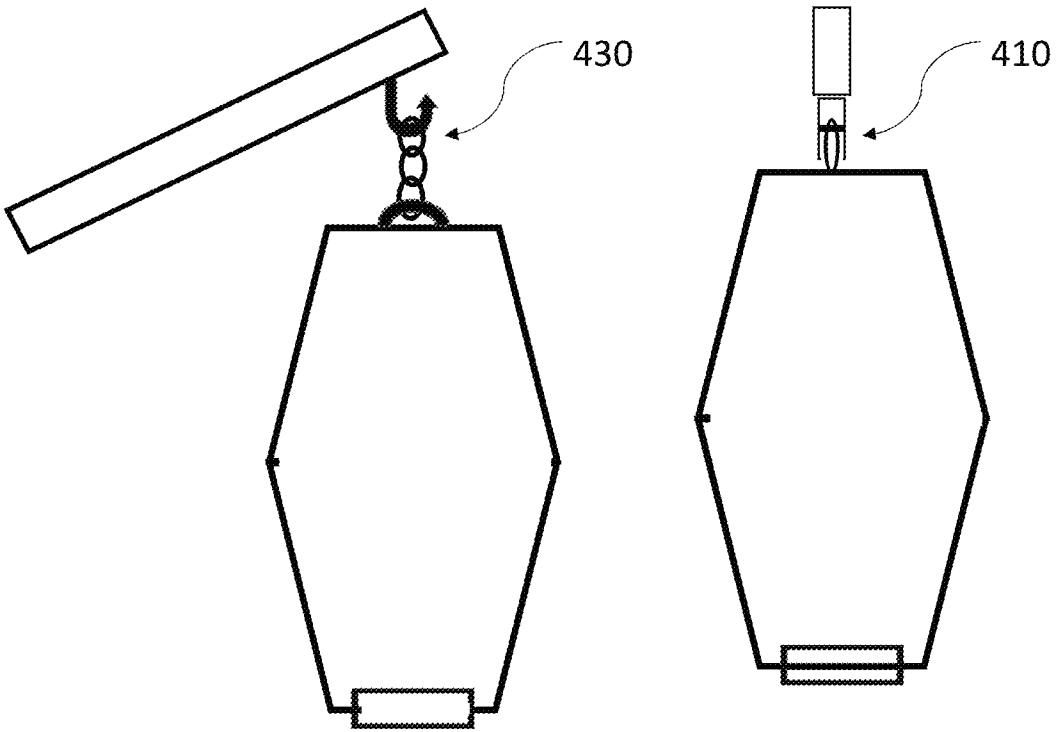
FIG. 17H depicts front and side views of alternative attachment mechanisms for attaching a seat assembly structure to an overhead beam.

FIG. 17H depicts a sampling of attachment mechanisms 410, 420, 430 whereby a swing/seat assembly is attached to a supporting upper arm. Attachment mechanism 410 depicts an attachment mechanism that restricts lateral movement during the forward and back swing of the swing/seat assembly. Attachment mechanism 430 depicts a chain and hook system. Attachment mechanism 420 depicts a rope/wire attachment mechanism that permits forward, back and lateral swing motion as well as a height adjustment mechanism, in this instance, consisting of rope/wire, pulleys and an anchor, such as a cleat. An attachment mechanism may further be attached to the overhead beam by a slider (or rail) assembly that permits the attachment point to slide along a portion of the underside of the beam during the fore-and-aft motion of a rowing stroke to permit an additional movement of the seat assembly, and permits the attachment to be locked in place along the slider assembly for additionally customizing the precise swing fulcrum of the seat assembly according to individual user preferences. As will be clear to a person experienced in hanging seat assemblies (in view of the current disclosure), multiple other implementations of swing-enabling and detachable, height-adjustable attachment mechanisms for hanging seats from a point above are available, the design and choice of which are dependent on the intended usage for any particular configuration and use of the system, such as, by way of example, for competitive or age-assisted or physical-therapy assisted rowing or bicycling and for large, medium or small dimensions of a person.

Figure 17I:
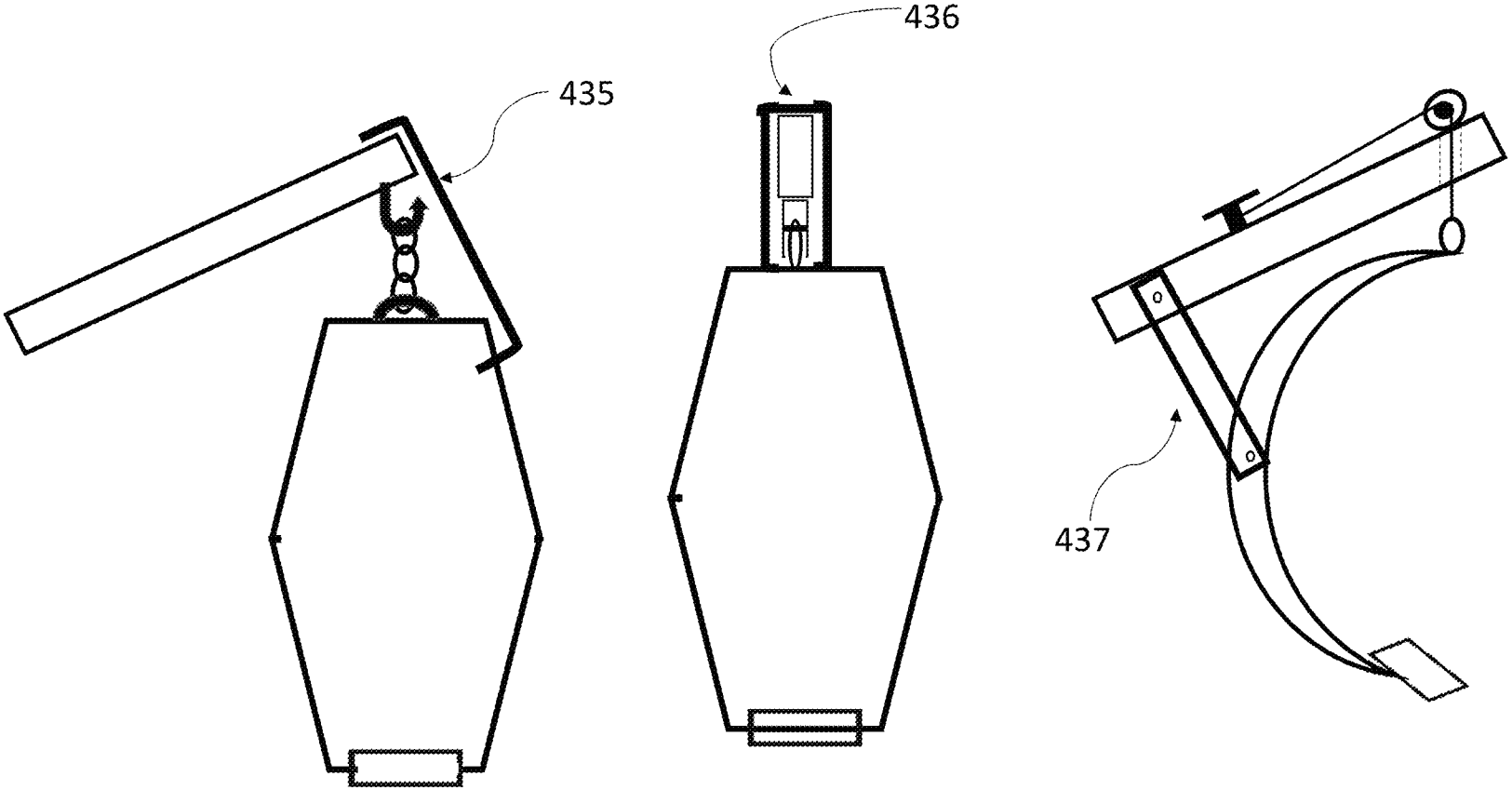
FIG. 17I depicts front and side views of mechanism for locking the seat assembly structure at a certain position in its swing arc.

FIG. 17I depicts a set of detachable components 435, 436 and 437 for enabling a user to lock a swing assembly in a specific position, whether to enable a user to get on board without the seat swinging or to hold the seat in a specific position for a specific exercise purpose or otherwise. As will be clear to a person experienced in hanging seat assemblies (in view of the current disclosure), multiple other implementations of removable mechanisms for locking a hanging seat in place (and prevent it from swinging forward and back and side-to-side) are available, the design and choice of which are dependent on the intended usage for any particular configuration and use of the system, such as, by way of example, for physical-therapy or age-assisted exercise.

Figure 18A:
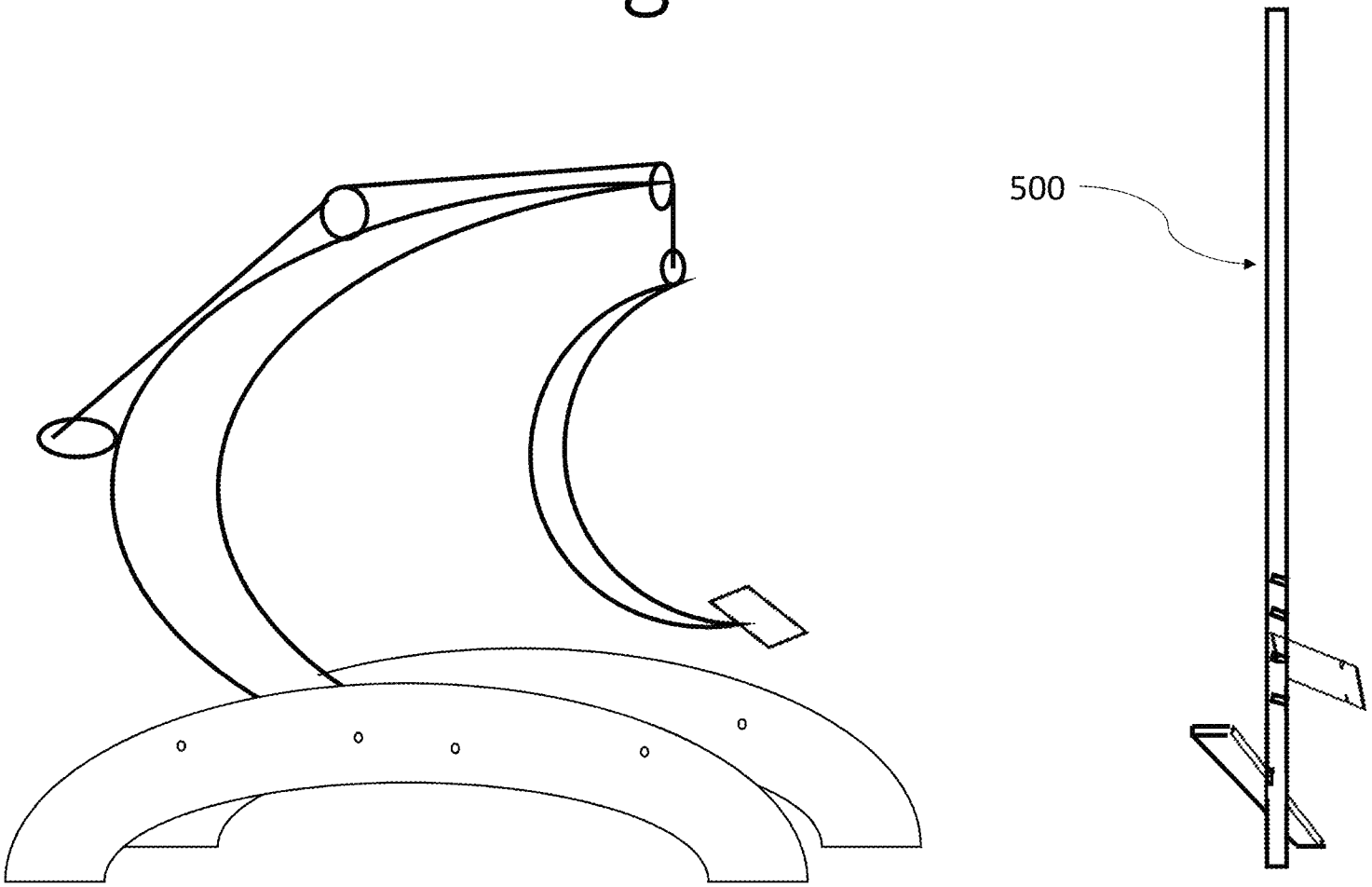
FIG. 18A depicts a side view of a seat and base structure assembly with a detachable, interchangeable exercise component.

FIG. 18A depicts an illustrative example of the invention of FIG. 16 wherein the single arched component assembly and the center beam/rail and tention/retraction assembly 500 are detachable from each other. This enables the swing chair to be transformed into a swinging chair (with replaceable alternative swinging seat designs, such as designs that are more comfortable than a rowing seat) and the center beam/rail assembly can be detached and stored separately while not in use as a rowing machine.

FIG. 18B depicts the detachable, interchangeable exercise component 550 incorporating a recumbent bicycle wheel and pedal assembly. A system combines the ability to select among alternative swing seat designs, alternative designs of stable structural beams for attaching a hanging seat and selectable interchangeable beams with alternative exercise components (including, but not limited to, the rowing device described in FIGS. 1 to 11) the reconfigurable capabilities expand into numerous designs optimizable by individuals in their homes/offices/apartments, gyms, physical therapy centers and other environments based on the requirements of the context.

Figure 18C:
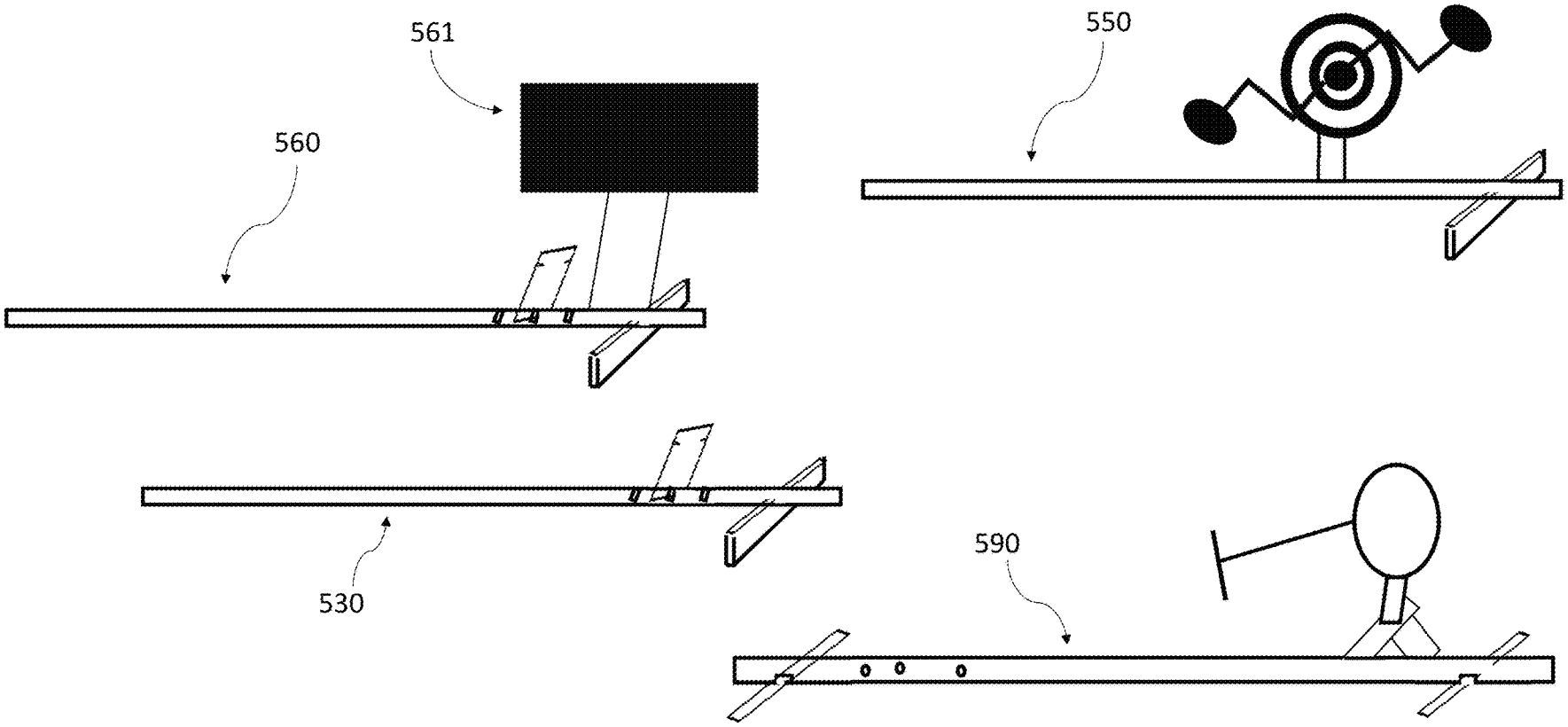
FIG. 18C depicts side views of a number of alternative detachable, interchangeable exercise components.

FIG. 18C depicts a variety of implementable alternatives for a detachable, interchangeable exercise component (separate from the swinging seat assembly components and structure), including: one with the invention of FIG. 1 and a monitor 561 for displaying information about the exerciser's workouts (e.g., calories burned, strokes rowed, time exercised, time intervals, instructional videos, etc, as well as entertainment and conference calling and general internet access and browser features); one with a bicycle pedaling component 550 thereby creating a recumbent bicycle exercise machine when coupled with the swing seat assembly; and one with a starboard-side "sweep" rowing component 590.

These are examples of any number of different configurations and types of exercise and fitness integrations that are interchangeable with the swing/seat assembly of prior figures. Further, each configuration takes advantage of the swing/seat assembly's characteristics, such as, for example, independent stability and optimized seat choices/designs such that these fitness-specific add-ons/integrations can be lightweight in comparison to designs of current, single structure fitness machines and equipment.

As an alternative embodiment applicable to specific instances, the based beam can be designed with an attachment point for multiple types of interchangeable fitness components, such as an attachment point/tower that can alternately be used to removably hold a rowing retraction system and also be used to removably hold a bicycle pedaling system.

Figure 18D:
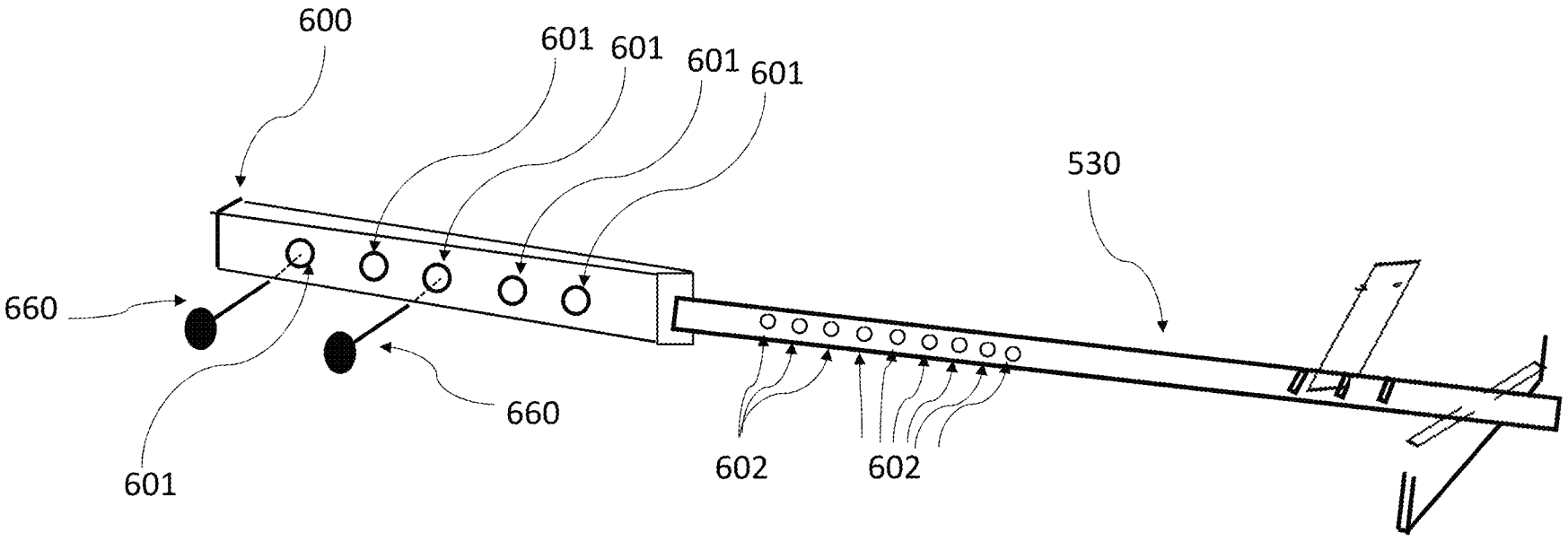
FIG. 18D depicts a side view of system for detachably connecting a seat and base structure with a detachable, interchangeable exercise component.

FIG. 18D depicts an illustrative example of a structure whereby the detachable and alternate fitness structures (such as the retractable rowing system 530) of FIG. 18B are insertably attached to a beam 600 wherein beam 600 is integrally a part of the swing/seat assembly of earlier FIGs. The two beams 600, 530 are attached in this FIG. 18D by means of pins/bolts 660 passing through holes 601 in beam 600 and also passing through holes 602 of structure 530, wherein the precise holes chosen for pin insertion allow for the length of the combined beams 600, 530 to vary depending on the need of the person exercising. Alternative bean designs (e.g., round, u-shaped and other shapes) and attachment/locking systems (e.g., compression sleeves) are available depending on the needs of any fully-architected system implementing the invention.

Figure 19:
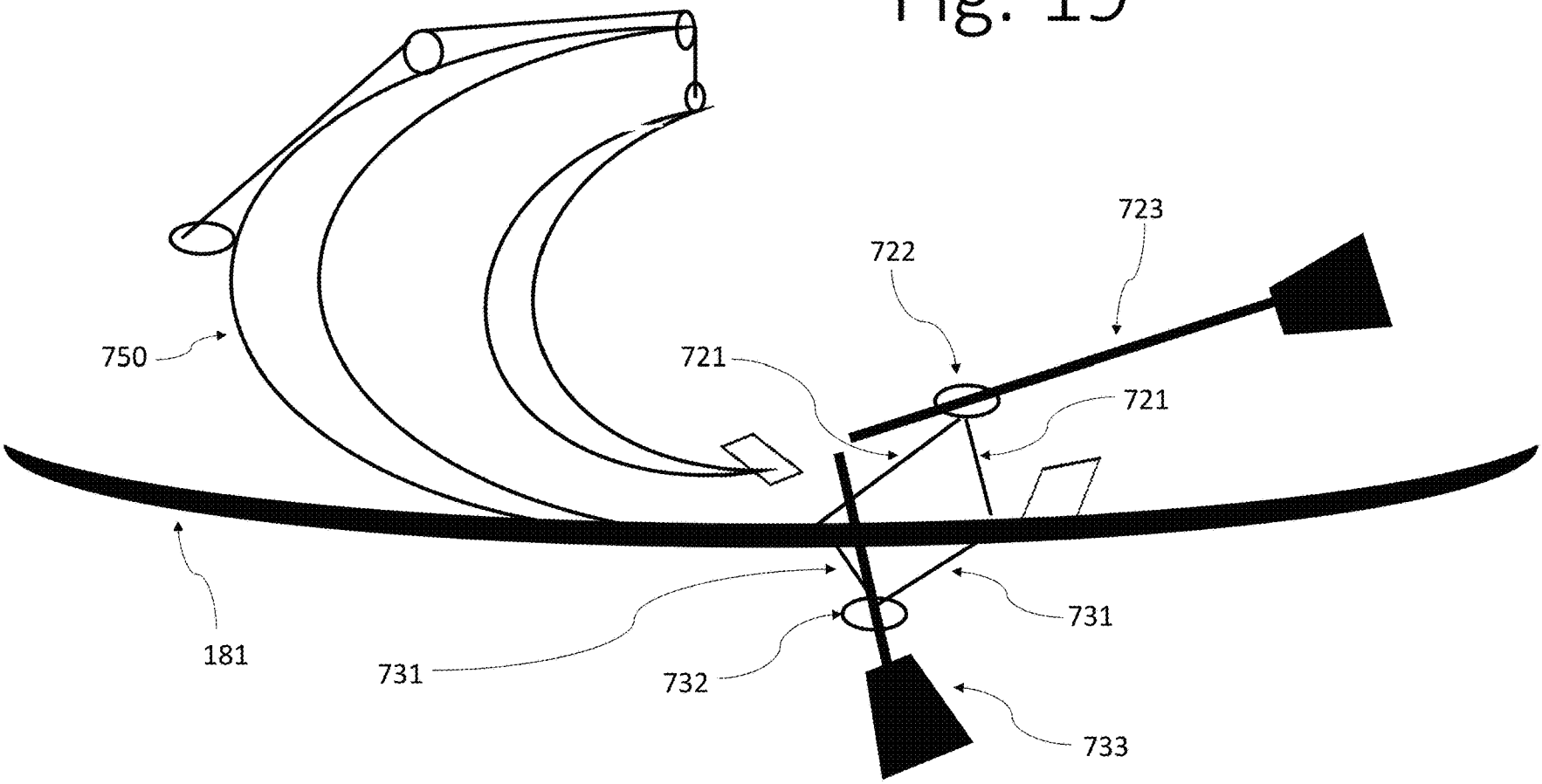
FIG. 19 depicts a side view of a boat with a traditional set of oars and oar locks and a swing seat and the swing seat supporting structure in a single scull arrangement.

FIG. 19 depicts the swing rower implemented in an actual rowing shell boat 181, with oars, oar locks and riggers. This FIG. 19 depicts a type of rowing shell called a "scull" because it has oars on both sides. This FIG. 19 depicts how the swing rower invention obviates the need for seat that runs on tracks on or in the hull, thereby removing all the friction throughout the stroke and further removing the complexity of the seat assembly and the risk that seat will jump off its rails during a stroke. Further, this FIG. 19 depicts the one-to-one mapping of the rowing stroke as between a boat implementation and a rowing machine implementation, thereby creating an optimal training system in the rowing machine.

A further benefit of replacing traditional seat assemblies that move/roll fore-and-aft on rails or grooves below the seat with a swing assembly as depicted in the Figures is that traditional seats transfer the weight of the rowers towards the bow during the portion of a rowing stroke when the oar blades are pulled through the water. This drives the bow of the boat deeper into the water, which has the effect of slowing the boat down. As this slowing effect happens at the end of every rowing stroke, the cumulative effect over the course of multiple rowing strokes can be substantial. By reducing the amount the bow is driven deeper into the water during a rowing stroke, the swing seat assembly improves the speed of the boat and the efficiency of translating the power of the rowers' efforts into forward speed of the boat.

FIG. 19 schematically depicts starboard-side oar lock 722, rigger components 721 and oar 723. Further, this FIG schematically depicts port-side oar lock 732, rigger components 731 and oar 733. Component 750 is the main structural beam that supports the swing chair assembly at its top, and, at its bottom is either detachably or integrally a part of the hull of the boat 181. By positioning the base of the main structural beam detachably or integrally with centerline keel of the boat, the main structural component's weight is located as low as possible in the boat. The structural integration of the main structural beam 750 with the hull or keel of the boat is optimally done such that side-stays are not required, although in some embodiments side stays and possibly fore and/or aft stays may be an optimal installation configuration.

Figure 20:
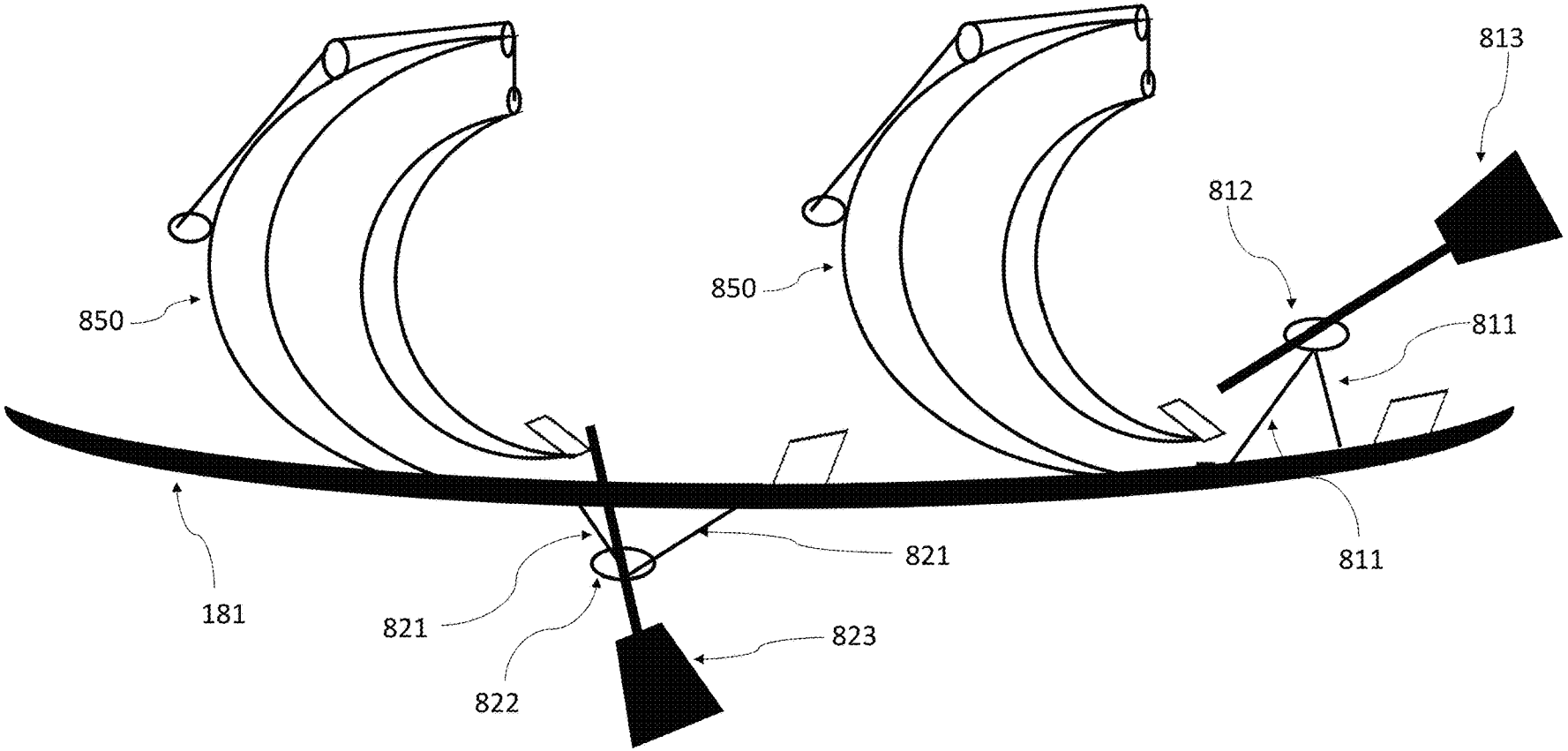
FIG. 20 depicts a side view of a boat as described in FIG. 19 in a two-rower (double) sweep-oar configuration.

FIG. 20 depicts a boat 181 with multiple swing air seat assemblies for boats with multiple rowers. In this instance, there are two seat assemblies, and each rower has one oar, one on the starboard side and one on the port side. It will be understood that as many seat assemblies as rowers can be implemented in this way, and regardless of whether each rower has one oar or two oars.

FIG. 20 schematically depicts starboard-side oar lock 812, rigger components 811 and oar 813. Further, FIG. 20 schematically depicts port-side oar lock 822, rigger components 821 and oar 823. Component 850 is a main structural beam that supports each swing chair assembly at its top, and, at its bottom it is either detachably or integrally a part of the hull of the boat 181.

Figure 21:
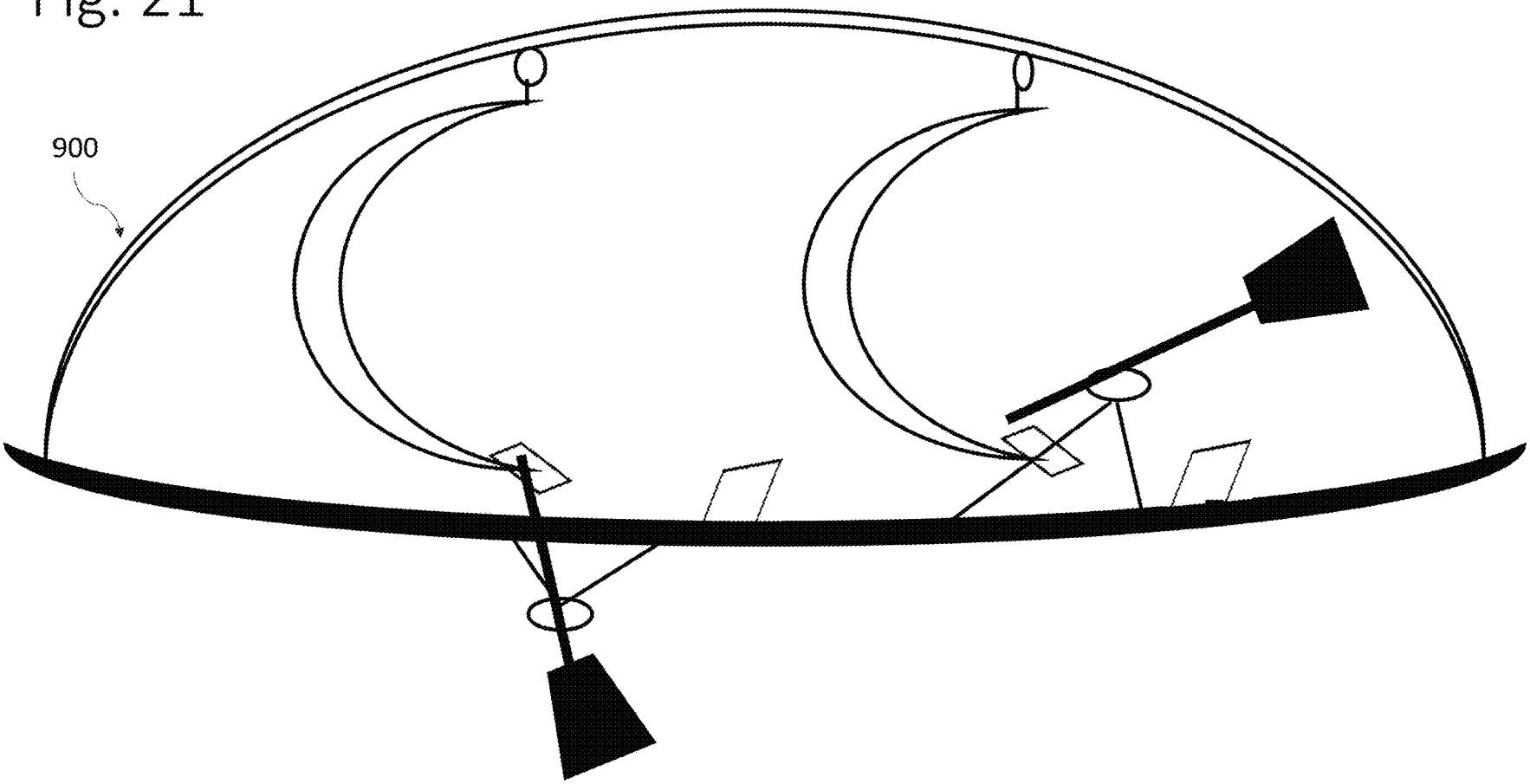
FIG. 21 depicts a side view of an implementation of FIG. 20 wherein the overhead swing seat supporting structure supports multiple hanging seats.

FIG. 21 depicts the illustrative example of FIG. 20 wherein a single arched component 900 is implemented as a singular component from which all the swinging seat assemblies are hung. This may be a preferred embodiment for certain boat designs as it may reduce weight and numbers of separate components, as well as if the single arched component 900 is removably attached from the hull thereby permitting separate storage of the hull and the single arched component and its swinging seat assemblies when the boat is removed from the water. Further, this permits different single arched components with pre-configured seat assemblies to specific rowing teams such that a single hull can be easily optimized for different teams of rowers by swapping out a single arched component for another one with pre-configured swing seats positioned and set for specific rowers at each rowing position.

In FIGS. 19, 20 and 21, an additional benefit, of the components 750, 850 and 900 respectively, is that in an embodiment the leading edge and cross-sectional design of the components (the leading edge meaning the edge towards the bow of the boat) incorporates an aerodynamically optimized shape such that the wind flow (and, hence wind resistance) on the back(s) of the rowers is redirected and thereby reduced, and thereby enabling creating additional forward boat speed under the same exerted effort by the rowers. The wind resistance on the essentially flat backs of the rowers is a substantial inhibitor to the speed of the boat powered by the rowers. By utilizing these components 750, 850 and 900 to improve the aerodynamic flow, more of the effort of the rowers is translated into forward speed of the boat.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted in the context. The terms "comprising," "having," "including" and "containing" are to be construed as open-ended terms (i.e., meaning "including, but not limited to") unless otherwise noted. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Illustrative examples of invention are described herein, including the best mode known to the inventor for carrying out the invention. Variations of those illustrative example embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context. Accordingly, the invention should only be limited by the appended claims and equivalents thereof, which claims are intended to cover such other variations and modifications as come within the spirit and scope of the invention.

What is claimed is:

1. An exercise apparatus comprising an integral system of including:

a base comprising a hull of a boat, a curved beam to which a swinging seat is detachably positioned, and a rowing stroke assembly comprising a foot board and oar lock structures configured to hold oars, wherein the rowing stroke assembly is positioned aft of an at-rest hanging position of the swinging seat.

2. The exercise apparatus of claim 1 wherein the curved beam is structurally integral to the hull of the boat.

3. The exercise apparatus of claim 2 wherein the curved beam is structurally integral to a relatively low and centered section of the hull.

4. The exercise apparatus of claim 2 wherein the curved beam is detachably attached to the hull.

5. The exercise apparatus of claim 4 wherein the detachable curved beam is positionable fore-and-aft along the center line of the hull.

6. The exercise apparatus of claim 2 wherein the swinging seat is height-adjustable on the curved beam.

7. The exercise apparatus of claim 2 wherein the swinging seat comprises:

an arced beam including a lower arc end, a mid arc, and an upper arc end; and a seat assembly positioned at the lower arc end, wherein the mid arc allows for free movement of a back of a rower as the rower finishes a rowing stroke, wherein the arced beam includes a swivel attachment at the upper arc end, wherein the swivel attachment attaches to a head end of the curved beam such that motion of the arced beam facilitates fore-and-aft movement of the seat assembly as the rower moves along the forward-and-after centerline of the boat throughout repetition of a full rowing stroke.

8. The exercise apparatus of claim 7 wherein the arced beam is a compound structure comprising at least two rigid components with at least a hinge connecting multiple rigid components of the at least two rigid components.

9. The exercise apparatus of claim 1 wherein a leading edge of the curved beam is aero-dynamically designed to flow air to sides of and around a back of a rower on the swinging seat.

10. The exercise apparatus of claim 1 wherein the boat is a scull for a single rower with one oar extending on each side of the boat.

* * * * *